US006336244B1

(12) United States Patent
Tarutani et al.

(10) Patent No.: US 6,336,244 B1
(45) Date of Patent: Jan. 8, 2002

(54) ELECTRIC BLOWER AND ELECTRIC CLEANING DEVICE USING THE SAME

(75) Inventors: Takao Tarutani, Kakogawa; Toshihiro Suto, Kasai; Masaki Sasao, Kobe; Toshio Otani; Yoshihisa Ueno, both of Kasai; Noriaki Kimura, Himeji; Makoto Iwatake, Kasai; Koichi Nakai, Himeji; Toshinari Kobayashi, Ono; Sadaki Kodera, Kasai; Toshiyuki Fujiyoshi, Kasai; Yoshihiro Mori, Kasai; Takahiro Nishiyama, Kasai, all of (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 09/552,111

(22) Filed: Apr. 19, 2000

(30) Foreign Application Priority Data

Apr. 20, 1999 (JP) ..... 11-112174
Jun. 23, 1999 (JP) ..... 11-176860

(51) Int. Cl.[7] ..... A47L 5/14; A47L 5/22; A47L 9/22

(52) U.S. Cl. ..... 15/412; 15/327.2; 15/327.7; 15/346; 15/326

(58) Field of Search ..... 15/327.1, 327.2, 15/327.7, 326, 345, 346, 412, 413, 414

(56) References Cited

U.S. PATENT DOCUMENTS 2,044,830 A * 6/1936 Carstedt
RE32,027 E * 11/1985 Hyatt et al.
5,110,266 A * 5/1992 Toyoshima et al.
5,919,030 A * 7/1999 Iwatake et al.
6,237,188 B1 * 5/2001 Takemoto et al.
6,243,915 B1 * 6/2001 Nakai et al.

FOREIGN PATENT DOCUMENTS

| | | |
|---|---|---|
| CA | 972510 | * 8/1975 |
| DE | 2218351 | * 11/1973 |
| JP | 61-49197 | * 3/1986 |

* cited by examiner

*Primary Examiner*—Terrence R. Till
(74) *Attorney, Agent, or Firm*—Morrison Law Firm

(57) ABSTRACT

In an electric blower, exhaust air discharged radially from a centrifugal fan is redirected to a motor drive section by a diffuser and a fan cover. The air passes from a ventilation opening on a motor frame and through a bracket to cool the motor drive section. A portion of the air from the centrifugal fan is bled off through exhaust openings without passing over the motor, whereby this portion remains cooler and cleaner than the air that passes over the motor. Air flows up a wand and then passes over the motor to cool the motor. This air passes through filters before being discharged. The portion of air that is bled off passes along a parallel path in the wand to agitate dirt, and to maintain the wand relatively cool. In one embodiment, some of the bled-off portion is discharged directly without passing along the wand.

9 Claims, 23 Drawing Sheets

A - A
B - B
3
31
31a
31b
32
32a
32b
33
33a
33b
34a
34b
34c
34d
34e
35
36
37
A
B

ELECTRIC BLOWER AND ELECTRIC CLEANING DEVICE USING THE SAME

BACKGROUND OF THE INVENTION

The present invention relates to an electric blower and an electric cleaning device using the same. More specifically, the present invention relates to an improvement in electric blowers that is suitable for use in electric cleaning devices that circulate exhaust air from the electric blower to the suction tool via a hose and a pipe.

In order to cool their heat-generating motor drive section, standard electric blowers used in electric cleaning devices and the like have taken all the exhaust air discharged radially from a centrifugal fan and redirected it in the direction of the motor shaft by guiding the air along a diffuser and the inner perimeter surface of a fan cover. The air passes through a diffuser return path and flows from an air passage formed on a motor frame through a bracket to cool the motor drive section. The air is then discharged outside through a bracket discharge opening.

In standard cleaning devices that are moved along floors, all the exhaust air from an electric blower mounted in the main cleaning device unit is discharged outside through a discharge opening in the back surface of the main unit or the like.

The debris sucked in with air through a floor suction tool or the like is passed through a pipe and a hose and collected in the main cleaning device unit. The debris enters a paper bag or the like and the air eliminated of debris is used to cool the motor drive section of the electric blower after which it is discharged outside through the exhaust opening. This can result in the discharged air blowing up dust that is present on the floor or carpet so that the dust is scattered all around the room.

Conventional technologies, e.g., Japanese examined utility model publication number 39-36553 and Japanese examined patent publication number 7-44911, have been developed in order to reduce the exhaust air blown out, improve debris collection, and the like. These technologies provide an electric cleaning device in which a hose, a pipe, and a suction tool connected to the main cleaning device unit are formed with an air intake path as well as a discharge path to allow the exhaust air to circulate.

However, in the conventional electric blower described above, the heat-generating motor drive section is cooled by taking all the exhaust air discharged radially by the centrifugal fan and redirecting it with the fan cover and the diffuser so that the air is passed through the bracket in which the motor drive section is mounted. This results in increased ventilation resistance, thus reducing suction properties.

Also, when the conventional electric blower described above is used in exhaust circulating cleaning devices described above, the cooling of the motor drive section results in a higher temperature for the exhaust air being circulated, leading to further increases in temperature. This increases the temperature of the main cleaning device unit, the hose, the pipe, and the motor itself. This can result in unpleasantness when using the cleaning device and may also invite deformation of the main cleaning device unit, as well as degradation or destruction of the motor or the like. Also, the contact between the carbon brush and the commutator of the motor generates carbon particles that enter the exhaust air cooling the motor drive section. When this air is circulated, carbon particles will adhere to the exhaust air path and can lead to the carbon particles being blown out from the suction tool and soiling the surface being cleaned.

These factors acted as obstacles in the practical use of exhaust circulating cleaning devices.

In response to these problems, a separate fan can be attached to the motor shaft on the side opposite from the centrifugal fan (the rear side) in order to cool the motor drive section. Also, the paths of the exhaust air on the suction side and the exhaust air used for cooling are completely separated and a "wet and dry" motor is used to allow air containing moisture to be sucked in. However, with this arrangement, the cooling fan is attached separately, leading to a larger electric blower (and electric cleaning device). This results in a more complex structure, a significant reduction in ease of production, and increased costs.

OBJECTS AND SUMMARY OF THE INVENTION

It is an object of the present invention is to provide a blower for an electric cleaning device which overcome the problems described.

It is a further object of the invention to provide an electric blower having a simple structure that can improve suction properties.

Another object of the present invention is to prevent increases in temperature of circulating exhaust air in exhaust-circulation electric cleaning devices.

In order to achieve the objects described above, the present invention provides an electric blower wherein a diffuser is interposed between a centrifugal fan and a motor frame. A bracket in which a motor drive section is mounted is disposed downstream from the motor frame. The centrifugal fan and the diffuser are covered by a fan cover. Exhaust air discharged radially from the centrifugal fan is redirected to the motor drive section by the diffuser and the fan cover. The exhaust air passes from a ventilation opening of the motor frame through the bracket to cool the motor drive section. An exhaust opening is formed at a section of the fan cover. A portion of exhaust air discharged from the centrifugal fan is discharged from the exhaust opening of the fan cover.

The present invention can also have the exhaust opening formed at an outer perimeter section of the fan cover.

Furthermore, the present invention can also have a cooling fan disposed to cool the motor drive section.

Also, the present invention provides an electric cleaning device wherein an exhaust flow path and a suction flow path are formed in a hose, pipe, and suction tool connected to a main cleaning device unit in which is mounted an electric blower. The exhaust flow path circulates exhaust air from the electric blower. The electric blower described above is used so that exhaust air discharged from the exhaust opening of the fan cover is circulated to the exhaust flow path.

The present invention also provides an electric cleaning device wherein an exhaust flow path and a suction flow path are formed in a hose, pipe, and suction tool connected to a main cleaning device unit in which is mounted an electric blower. The exhaust flow path circulates exhaust air from the electric blower. The electric blower described above is used so that exhaust air discharged The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5(*b*) is a side-view of the vaned diffuser of FIG. 5(*a*).

FIG. 5(*c*) is a rear-view of the vaned diffuser of FIG. 5(*a*) showing the side toward the motor frame.

FIG. 11(*b*) is a cross-section drawing along the A—A line from FIG. 11(*a*).

FIG. 11(*c*) is a side-view drawing of the connecting pipe of FIG. 11(*a*).

FIG. 11(*d*) is an end-surface drawing seen from one end of FIG. 11(*c*).

FIG. 11(*e*) is an end-surface drawing seen from the other end of FIG. 11(*c*).

FIG. 11(*f*) is a cross-section drawing along the B—B line from FIG. 11(*c*).

FIG. 12(*b*) is a cross-section detail drawing of FIG. 11(*b*) with one section omitted.

FIG. 13(*b*) is an exploded view of FIG. 13(*a*).

FIG. 14(*b*) shows formations of the fan cover with non-uniform intervals.

FIG. 14(*c*) shows formations on only on one side of the perimeter of the fan cover outer perimeter section.

FIG. 15(*b*) is a side-view drawing if FIG. 15(*a*).

FIG. 15(*c*) is a rear-view drawing of the motor frame side.

FIG. 18(*b*) shows openings in the fan cover in which the edge of the opening opposite from the direction of rotation of the centrifugal fan is formed in alignment with and to match the rib sloped toward the direction of rotation of the centrifugal fan.

FIG. 18(*c*) shows openings in which the edge of the opening toward the direction of rotation of the centrifugal fan is sloped relative to the motor shaft.

FIG. 18(*d*) is a combination of FIG. 18(*b*) and FIG. 18(*c*).

FIG. 23(*b*) is a schematic plan drawing of the fan cover positioning/fixing sections of FIG. 23(*a*).

FIG. 23(*c*) is a schematic cross-section drawing of FIG. 23(*a*) as seen from the side.

FIG. 24(*b*) is a schematic plan drawing of 24(*a*).

FIG. 24(*c*) is a schematic cross-section drawing of 24(*a*) as seen from the side.

FIG. 25(*b*) is a schematic plan drawing of FIG. 25(*a*).

FIG. 25(*c*) is a schematic cross-section drawing of FIG. 25(*a*) as seen from the side.

FIG. 26(*b*) is a schematic plan drawing of FIG. 26(*a*).

FIG. 26(*c*) is a schematic cross-section drawing of FIG. 26(*a*) as seen from the side.

FIG. 27(*b*) is a schematic plan drawing of FIG. 27(*a*).

FIG. 27(*c*) is a schematic cross-section drawing of FIG. 27(*a*) as seen from the side.

FIG. 28(*b*) is a side-view drawing of the section of FIG. 28(*a*).

FIG. 29(*b*) is a side-view drawing of the fan cover of FIG. 29(A).

FIG. 30(*b*) is a side-view drawing of the piece of FIG. 30(*a*).

DETAILED DESCRIPTION OF THE PREFERRED EMBODIMENTS

Figure 1:
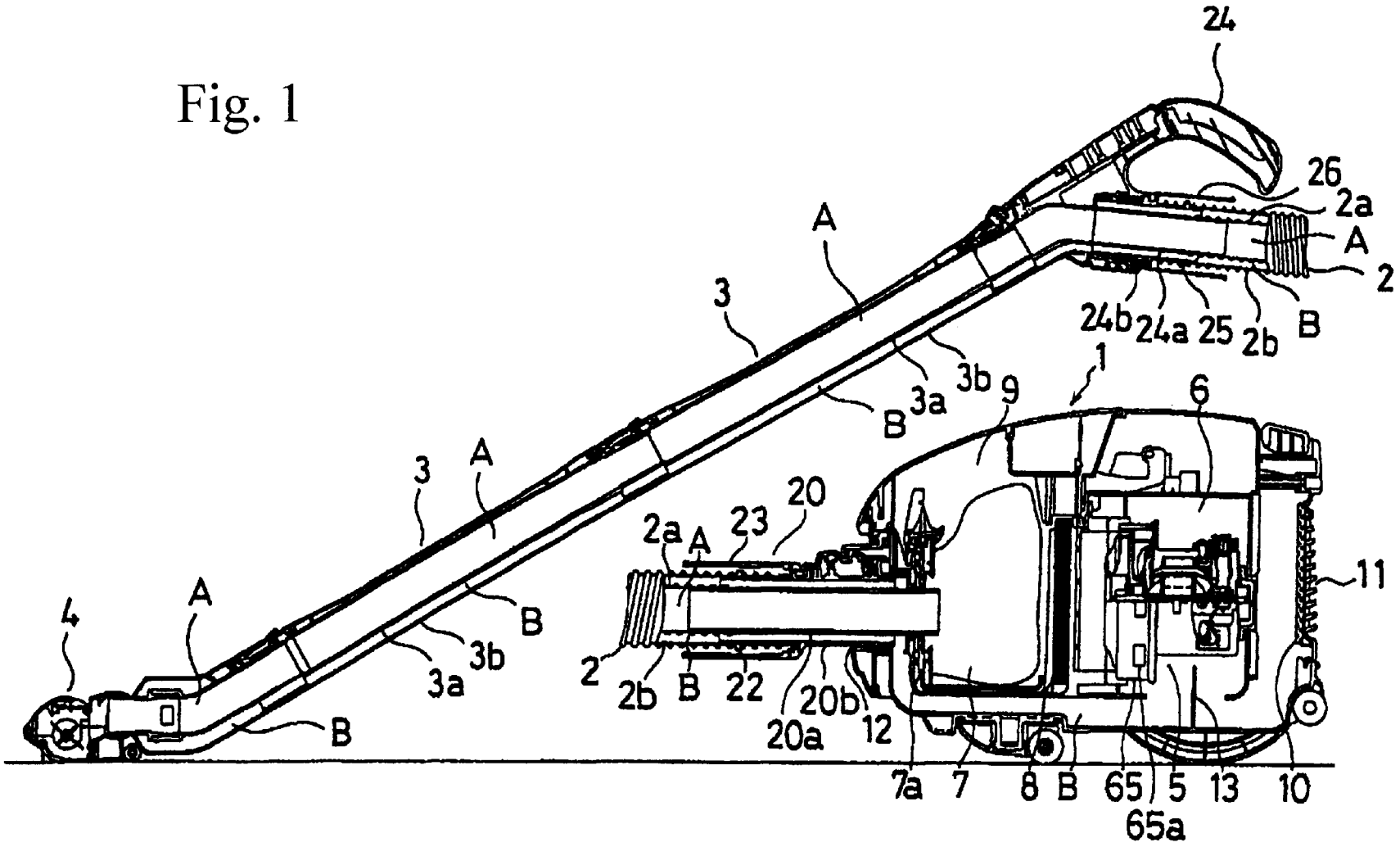
FIG. 1 is a drawing of the overall structure of an embodiment of an electric blower according to the present invention and an exhaust-circulating cleaning device using the same. An intermediate section of the hose is omitted to facilitate the drawing.
Figure 2:
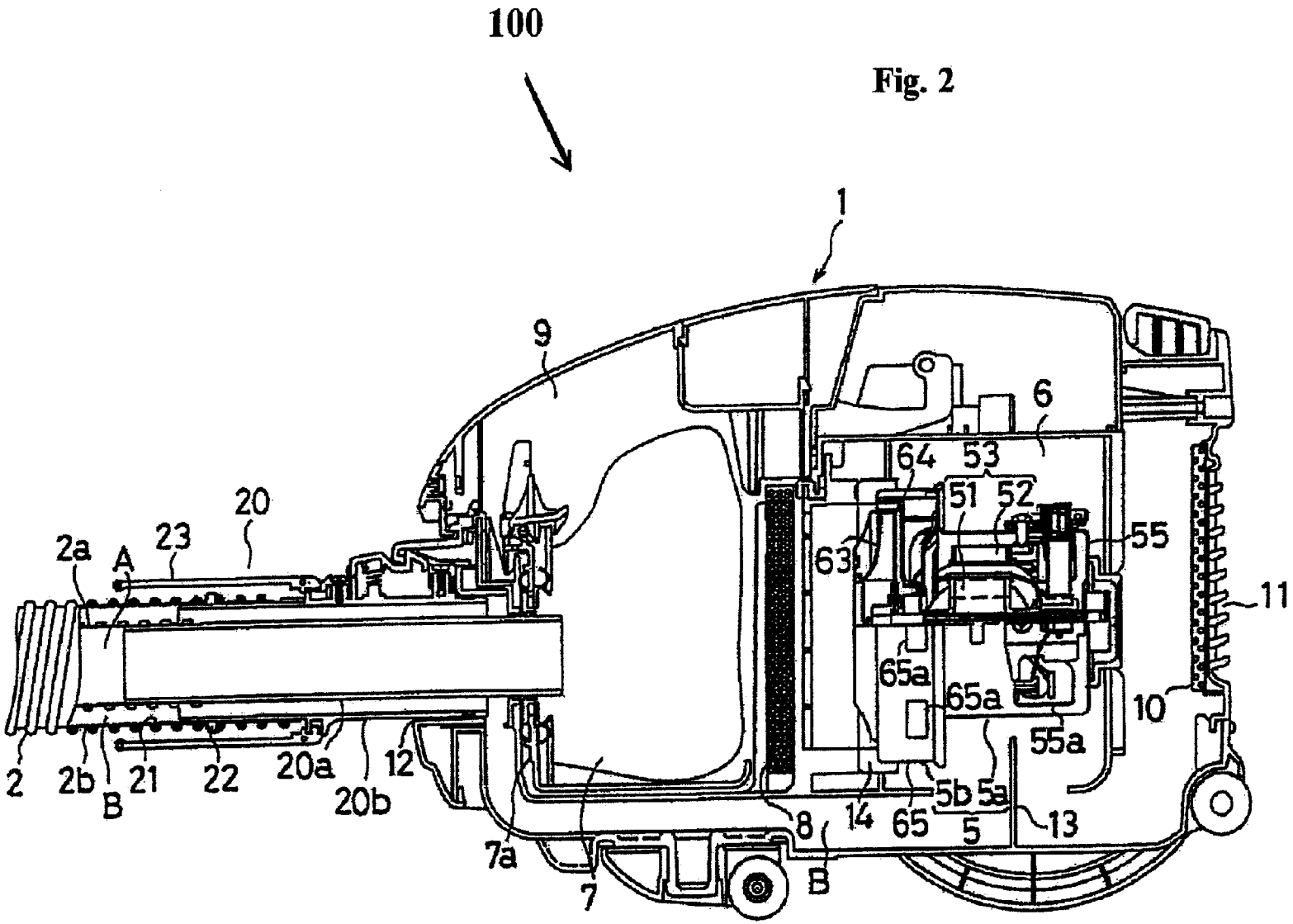
FIG. 2 is a cross-section detail drawing of the main cleaning device unit from FIG. 1.

Referring to FIG. 1 and FIG. 2, an electric blower and an exhaust-circulation electric cleaning device, shown generally at 100, includes a main cleaning device unit 1, a hose 2, a connecting pipe 3, a floor suction tool 4, and the like.

Inside the main cleaning device 1 are disposed: a motor chamber 6 holding an electric blower 5 used for suction; and a dust collection chamber 9 using a paper pack 7 and a fine dust filter 8.

An exhaust opening 11 located on the side toward the back surface of the main cleaning device unit 1. Exhaust air cools a motor drive section, described later, of the electric blower 5. The exhaust air is discharged from a bracket exhaust opening and finally discharged outside through an exhaust opening 11 via an exhaust filter 10.

A section of the main cleaning device unit 1, the hose 2, the connecting pipe 3, and the floor suction tool 4 are formed with counterflowing flow paths having a two-layer structure divided into a suction flow path A and an exhaust flow path B.

A portion of the exhaust flow path B, within main cleaning device unit 1, which circulates the exhaust air discharged from the exhaust opening of the fan cover outer perimeter, described later, of the electric blower 5, is located below the dust collection chamber 9 and the electric motor chamber 6. This exhaust flow path B communicates with the exhaust flow path B of a hose joint 20 mounted on a hose insertion opening 12 of the main cleaning device unit 1. The circulating exhaust flow path B toward the bottom of the main cleaning device unit 1 is separated by a partition wall 13 from the exhaust flow path to the exhaust opening 11 toward the back surface of the main cleaning device unit 1.

In the hose joint 20, connecting pipes 20*a*, 20*b* form a two-layered concentric structure. The end of the inner connecting pipe 20*a*, which forms the suction flow path A, projects beyond the end of outer connecting pipe 20*b*. One end of inner connecting pipe 20*a* is inserted into an attachment section 7*a* of the paper pack 7. The exhaust flow path B, formed by the outer connecting pipe 20*b*, communicates with the exhaust flow path B in the main unit 1.

The two layers at one end of a two-layered hose 2 is connected to the ends of the connecting pipes 20*a*, 20*b*. The hose 2 is formed from an inner flexible hose 2*a* known as a conduit hose such as those used to discharge water from washing machines and an outer flexible hose 2*b*. The outer flexible hose 2*b* is a standard flexible hose used in electric cleaning devices known as single-layer two-line hoses. Outer flexible hose 2*b* contains within it a coil 21 that is conductive (to allow it to be used as a signal line or the like) that has shape retention.

The inner conduit hose 2*a* is mounted and adhered to the projecting end of the inner connecting pipe 20*a*. The outer single-layer two-line hose 2*b* is twisted onto helical ribs 22 formed on the outer surface of the outer connecting pipe 20*b*.

The other end of the hose 2 is mounted and fixed in the manner described above to a grip 24, used to permit manual operator control, via inner and outer connecting pipes 24*a*, 24*b*, respectively. The inner flexible hose 2*a* is mounted and adhered to the projecting end of the inner connecting pipe 24*a*. The outer single-layer two-line hose 2*b* is mounted and fixed to the outer connecting pipe 24*b* by being twisted onto concentric or helical ribs 25 on the outer surface of the outer connecting pipe 24*b*. A cylindrical protective cover 26 covers the attachment section of the hose 2.

Connecting pipes 3, 3 each include: an inner cylinder 3*a* forming the suction flow path A having a roughly circular cross section; and an outer cylinder 3*b* forming the exhaust flow path B between itself and the inner cylinder 3*a*. The outer cylinder 3*b* covers the inner cylinder 3*a*. The upper portion of the outer cylinder 3*b* is formed integrally with the inner cylinder 3*a*.

Figure 3:
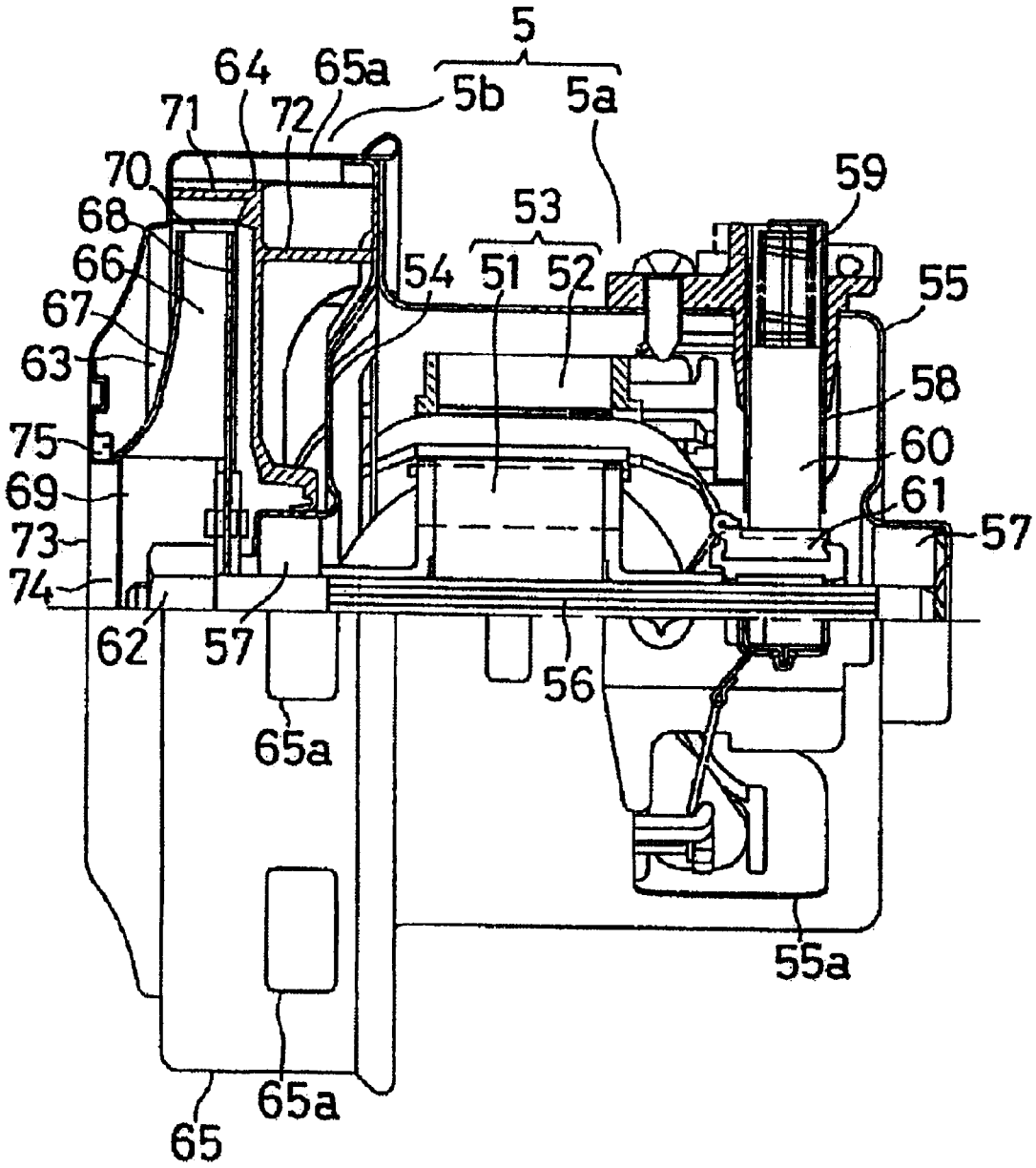
FIG. 3 is a half cross-section drawing showing the structure of the electric blower according to the above embodiment.

Referring to FIG. 3, the electric blower 5 includes a motor section 5*a* and a blower section 5*b*. A motor drive section 53, in the motor section 5*a*, includes a rotor 51 and a stator 52. The rotor 51 and the stator 52 are enclosed between a motor frame 54 and a bracket 55. A shaft 56 of the rotor 51 is rotatably supported on bearings 57, 57 disposed on the motor frame 54 and the bracket 55. The bracket 55 includes an exhaust opening 55*a* through which exhaust air used to cool the motor drive section 53 is discharged. A brush supporter 58 is attached to the bracket 55. A carbon brush 60 is pushed downward in the brush supporter 58 by a coil spring 59 so that the inner end of the carbon brush 60 is pressed into contact with the commutator 61 of the motor shaft 56.

The blower section 5*b* includes: a centrifugal fan 63 fixed via a nut 62 to the motor shaft 56 projecting from the motor frame 54. A diffuser 64 is fixed to the motor frame 54 interposed between the centrifugal fan 63 and the motor frame 54. The above elements of the blower section 5*b* are covered by a metallic fan cover 65.

The centrifugal fan 63 includes: a spiral blade 66 (see FIG. 4) and a front shroud 67 and a rear shroud 68 disposed on either side of the spiral blade 66. The front shroud 67 is formed with a suction opening 69 at a central portion thereof to suction air. The front shroud 67 is formed so that distance between it and the rear shroud 68 gets smaller toward the outer perimeter. At the outer perimeter section a discharge opening 70 is formed so that the air sucked in through the suction opening 69 toward the center is discharged radially from the discharge opening 70 toward the outer perimeter.

Figure 4:
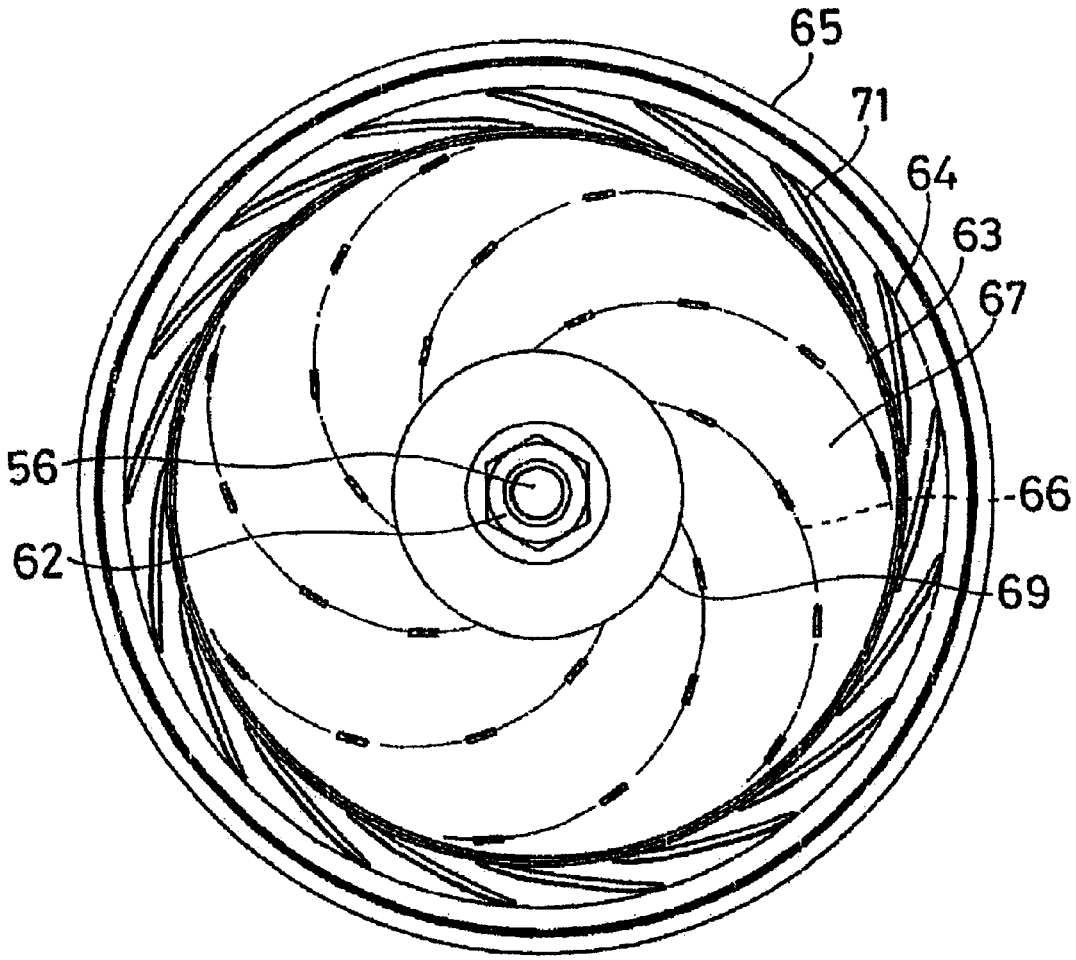
FIG. 4 is a front-view drawing of the electric blower with the front section of the fan cover cut away.
Figure 5C:
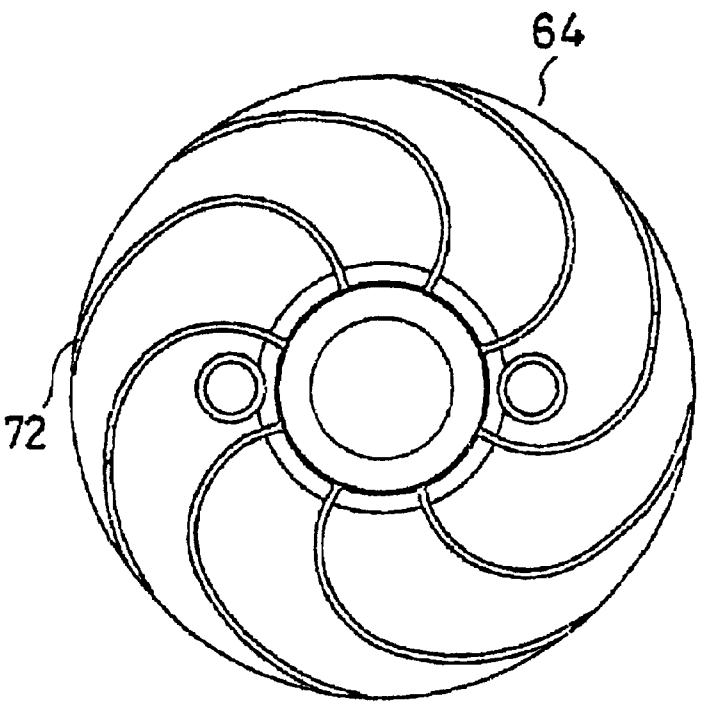
FIG. 5(*a*) is a front-view of a vaned diffuser, having volute ribs, showing the side toward the centrifugal fan.
Figure 5B:
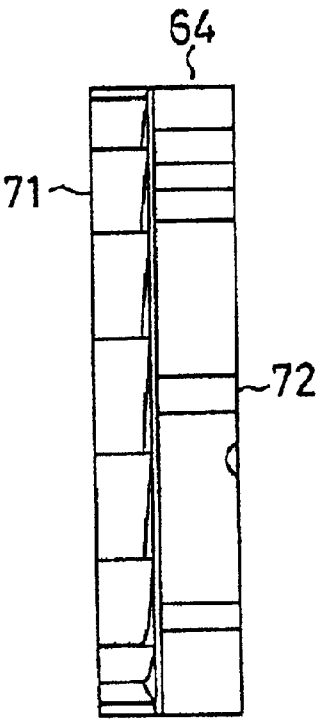
Figure 5A:
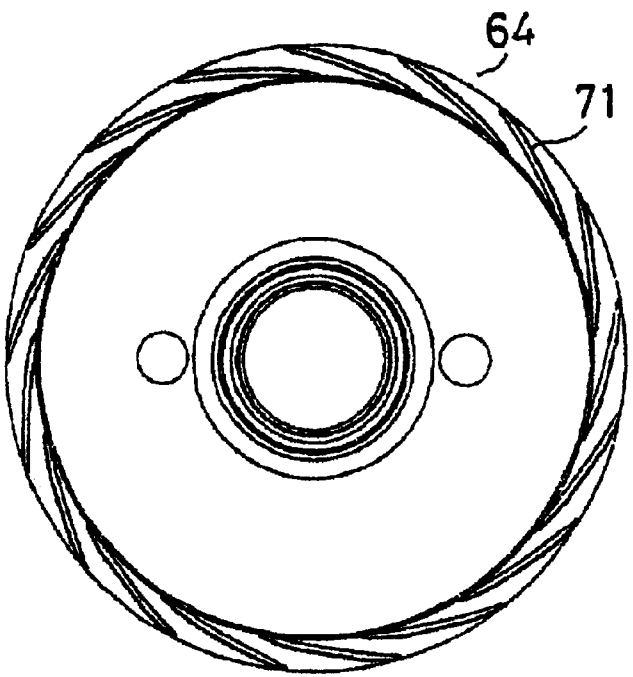

Referring now to FIGS. 4 and 5(*a*), the diffuser 64 is a vaned diffuser having multiple volute ribs 71 are on the side facing the centrifugal fan at its outer perimeter. The volute ribs 71 are inclined in the direction of rotation of the centrifugal fan 63 (counterclockwise in the figure).

Referring to FIG. 5(*c*), on the side of the motor frame, the exhaust air discharged from the centrifugal fan 63 and redirected via the volute ribs 71 and the fan cover 65 is guided to a ventilation opening (not shown in the figure) formed on the motor frame 54 by spiral-shaped guide ribs 72.

The fan cover 65 is formed so that it can be mounted to the outer perimeter section of the motor frame 54 where it covers the front surface and the outer perimeter surface of the centrifugal fan 63 and the diffuser 64. A suction opening 73 (FIG. 3) corresponding to the suction opening 69 of the centrifugal fan 63, is formed on the front surface of the fan cover 65. To position the fan cover 65 when it is mounted, the fan cover 65 is pushed in until the ends of the volute ribs 71 formed on the diffuser 64 touch the ceiling of the fan cover 65. This allows the fan cover 65 to be easily positioned.

The suction opening 73 of the fan cover 65 is formed with a cylindrical section 74, the end of which extends to the inside of the suction opening 69 of the centrifugal fan 63. A ring-shaped sealing member 75 formed from PTFE (polytetrafluoroethylene) resin or the like is mounted and fixed around the cylindrical section 74. The sliding contact of the end of the suction opening 69 of the centrifugal fan 63 prevents bypass air flow in which the air discharged from the discharge opening 70 of the centrifugal fan 63 is sucked into the suction opening 69 from the front side of the front surface of the centrifugal fan 63.

A plurality of rectangular exhaust openings 65*a* is formed at roughly identical intervals in the outer perimeter section of the centrifugal fan 63 downstream from the position of the centrifugal fan, i.e., toward the motor frame 54 of the diffuser 64. The exhaust openings 65*a* discharge a portion of the exhaust air discharged from the centrifugal fan 65.

Referring again to FIG. 2, when the electric blower 5 described above is attached to the motor chamber 6 of the main cleaning device unit 1, the edge of the outer perimeter on the front of the fan cover 65 is sealed and supported by a motor cushion 14 formed from a soft material such as rubber. The exhaust openings 65*a* at the outer perimeter section of the fan cover are not covered up by the motor cushion 14. Thus, bypass air flow, in which the air discharged from the exhaust opening circulates to the front of the fan cover 65, is avoided. Thus, the motor cushion 14 can be identical to the motor cushions used conventionally.

Figure 6:
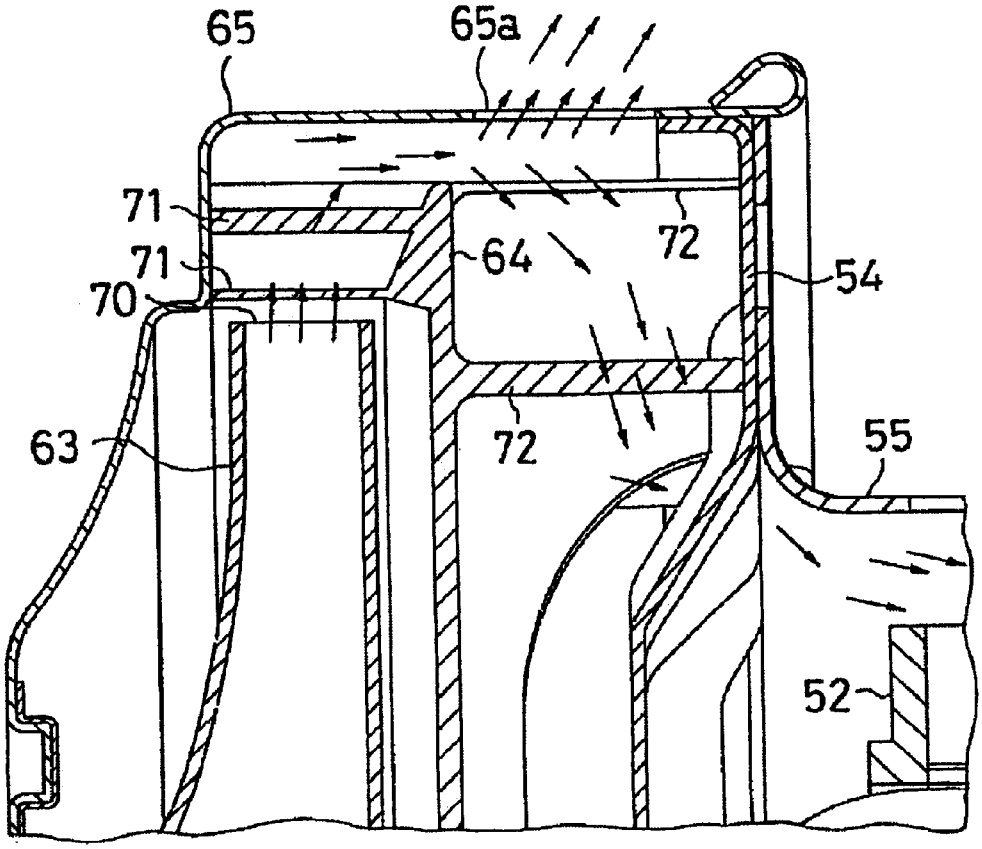
FIG. 6 is a detail drawing of the main elements from FIG. 3 with air flows indicated by arrows.
Figure 7:
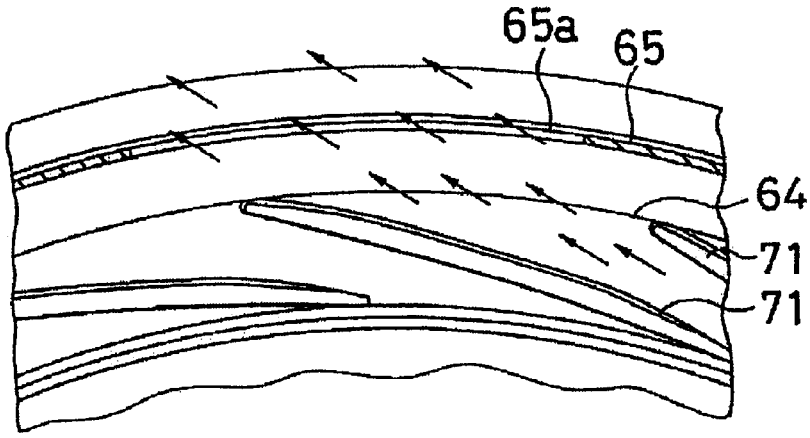
FIG. 7 is a detail drawing of the main elements from FIG. 4 with air flows indicated by arrows.

Referring to FIG. 6 and FIG. 7, detail drawings of the main elements from FIG. 3 and FIG. 4, include the direction of the flow of air indicated by arrows.

When the centrifugal fan 63 is rotated, the air sucked in from the suction opening 69 at the center of its front surface is discharged radially from the discharge opening 70 at the outer perimeter section. The air passes through the volute ribs 71, 71 of the diffuser 64 until it comes up against the inner surface of the outer perimeter section of the fan cover 65, where it is redirected in the direction of the guide ribs 72 of the diffuser 64.

The exhaust openings 65*a* are formed, as described above, at the outer perimeter section of the fan cover 65 corresponding to the guide ribs 72 of the diffuser 64. This allows a portion of the exhaust air to be discharged from the exhaust openings 65*a* outside the fan cover 65.

As with the conventional technology, the remaining exhaust air is guided along the guide ribs 72 of the diffuser 64 to the ventilation opening of the motor frame 54. The air passes into the bracket 55 from the ventilation opening where it cools the motor drive section 53. Finally, the air is discharged out from the bracket exhaust opening 55.

By forming the exhaust openings 65*a* at the outer perimeter section of the fan cover 65, as described above, a portion of the exhaust air discharged from the centrifugal fan 63 is discharged outside from the exhaust openings 65*a* of the fan cover outer perimeter section without undergoing a major redirection. This reduces the overall ventilation resistance, thus increasing the suction air volume and improving the properties of the electric blower 5.

A prototype was tested by the inventors. It was found that with 600 W input, the suction power for the conventional technology that does not include exhaust openings was 254 W. In contrast, the prototype formed with exhaust openings 65*a* showed an improvement to 270 W. This improvement demonstrates the advantages of the structure described above.

When an exhaust-circulating cleaning device equipped with the electric blower 5 as described above (FIG. 1), the suction of the electric blower 5 causes air mixed in with debris sucked in from the floor suction tool 4 to flow through the suction flow path A of the connecting pipe 3 and the suction flow path A of the hose 2. This air is collected in the main cleaning device unit 1. In the main unit 1, the debris is removed by the paper pack 7. The air is cleaned further by passing through the fine dust filter 8. The air is then sucked into the electric blower 5.

As described above, a portion of the exhaust air from the electric blower 5 is discharged from the exhaust openings 65*a* at the outer perimeter section of the fan cover. This air is then circulated back to the exhaust flow path B formed toward the bottom of the main cleaning device unit 1. This air passes through the exhaust flow path B of the hose 2 and the exhaust flow path B of the connecting pipe 3 and is circulated to the floor suction tool 4. The debris blown up by this exhaust air and newly suctioned outside air is circulated back into the suction flow path A of the connecting pipe 3.

A portion of the exhaust air from the electric blower 5 is directly circulated from the exhaust opening 65*a* formed on the outer perimeter section of the fan cover 65 to the exhaust flow path B formed toward the bottom of the main cleaning device unit 1. Thus, this air does not pass through the head-generating motor drive section 53, and the exhaust air is circulated in a cool state. As a result, the surface temperature of the hose 2 and the pipe 3 remain at a safe temperature, thereby preventing the user from experiencing discomfort. Also, problems relating to heat resistance and lifespan of the resin elements such as the hose 2 or the pipe 3, deformation of the main cleaning device unit 1, and deterioration or destruction of the electric blower 5 can be eliminated.

The exhaust air passing through the bracket 55 is used as in the conventional technology to cool the motor drive section 53. The exhaust air discharged from the fan cover exhaust openings 65*a* is circulated back to the floor suction tool 4 via the exhaust flow path B formed toward the bottom of the main cleaning device unit I and the exhaust flow path B of the hose 2 and the pipe 3. The air is blown on the floor surface to blow up debris, which is then sucked in. This improves the effectiveness of debris collection. Since this circulated exhaust air does not pass through the bracket 55, it does not contain carbon particles generated by the contact between the carbon brush 60 and the commutator 61, thus preventing the exhaust flow paths B, the floor surface, and the like from being soiled by carbon particles.

An electric blower 5 that is optimal for exhaust-circulating cleaning devices can be implemented simply by modifying the fan cover from a conventional electric blower. Thus, compared to the use of conventional "wet and dry" motors, the structure can be smaller, lighter, less expensive, and easier to produce.

Also, since the exhaust air for circulation and for cooling are not completely separated, the ratio between these can be easily changed simply by adjusting the total area of the exhaust openings 65*a* of the fan cover 65. This allows debris collection efficiency and easy adjustment of exhaust air temperature. Simply by changing the exhaust opening shape of the fan cover 65, the blower and the electric cleaning device can be made to easily accommodate various demands.

The exhaust openings 65*a* at the outer perimeter section of the fan cover 65 are formed downstream from the position of the centrifugal fan. This prevents the exhaust air discharged from the centrifugal fan 63 from being directly discharged out from the fan cover 65. The path formed by the diffuser 64 and the inner perimeter surface of the fan cover 65 converts dynamic pressure to static pressure. This air is then divided into exhaust air discharged out from the fan cover 65 and exhaust air used to cool the motor drive section 53. Thus adequate air flow for cooling the motor drive section is provided, while the conversion of dynamic pressure to static pressure increases the degree of vacuum. This increases the suction efficiency. Also, with the rotation of the centrifugal fan 63, noise is generated when the blades 66 of the centrifugal fan 63 pass by the volute ribs 71 of the diffuser 64. However, this noise can be restricted so that it does not directly go outside since the exhaust openings 65*a* at the outer perimeter section of the fan cover 65 are formed downstream from the position of the centrifugal fan and also because the exhaust openings 65*a* are not aligned with the noise source.

Figure 8:
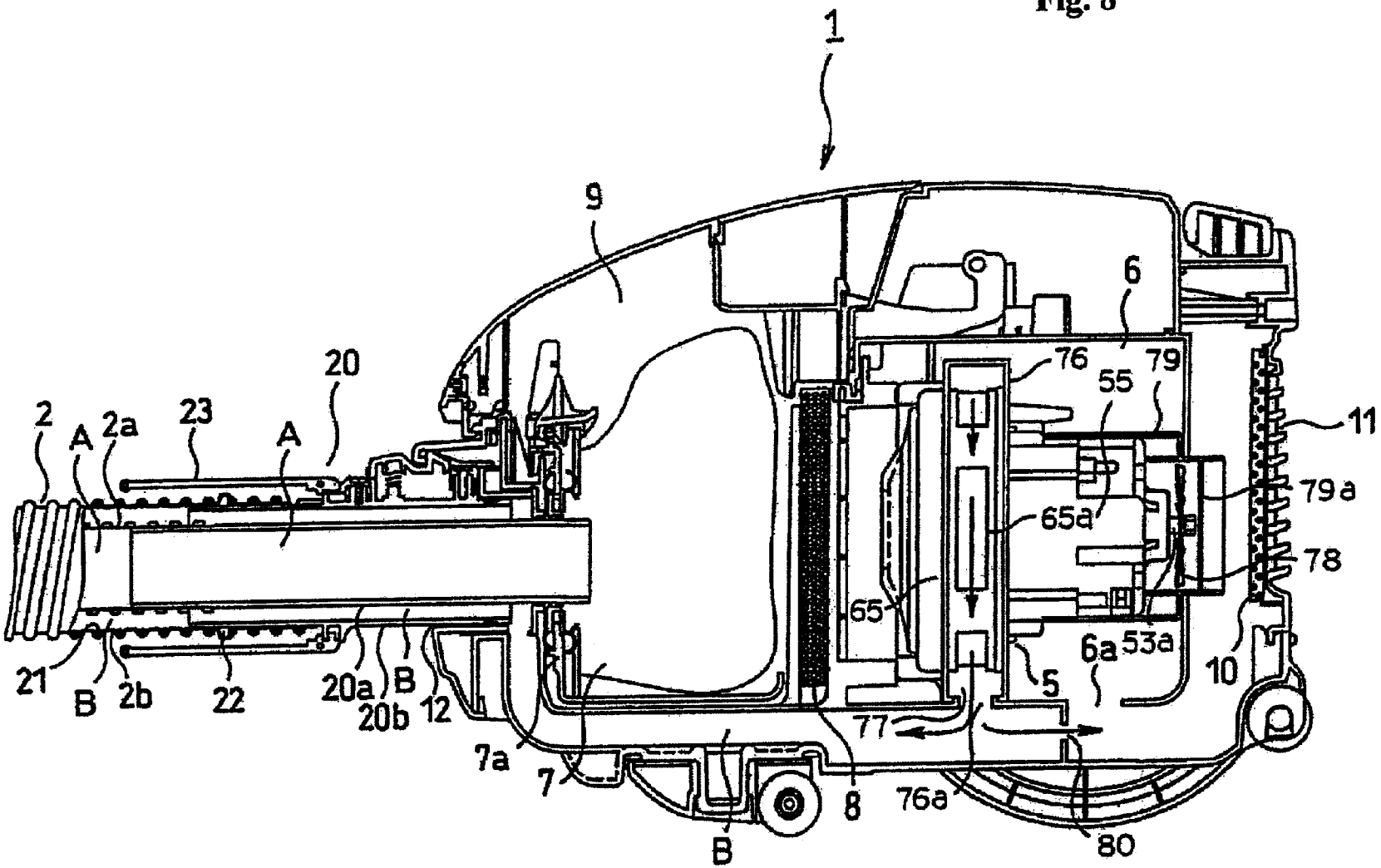
FIG. 8 is a detail cross-section drawing of a main clearing device unit according to another embodiment.
Figure 9:
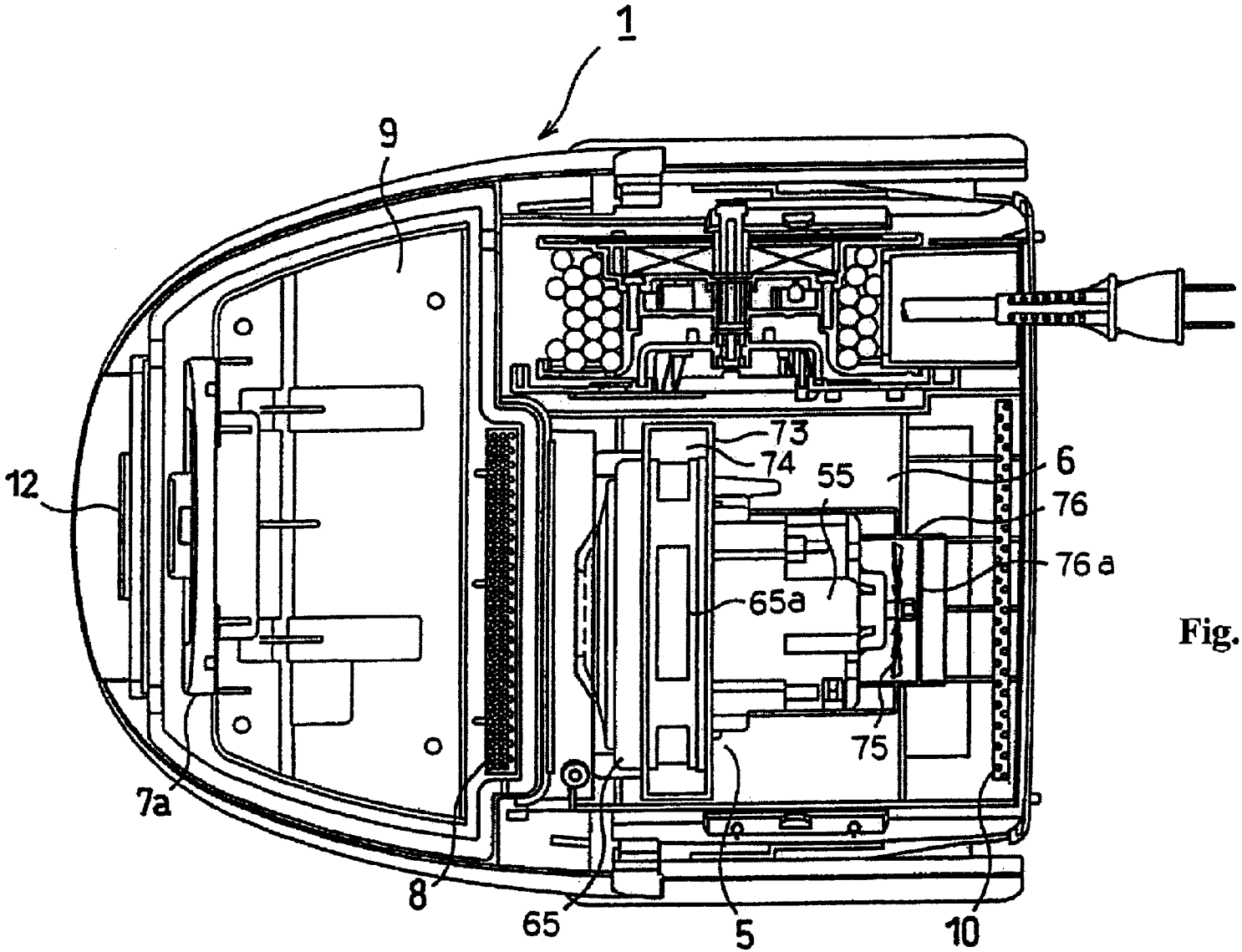
FIG. 9 is a drawing showing the structure inside the main cleaning device unit as seen from above.
Figure 10:
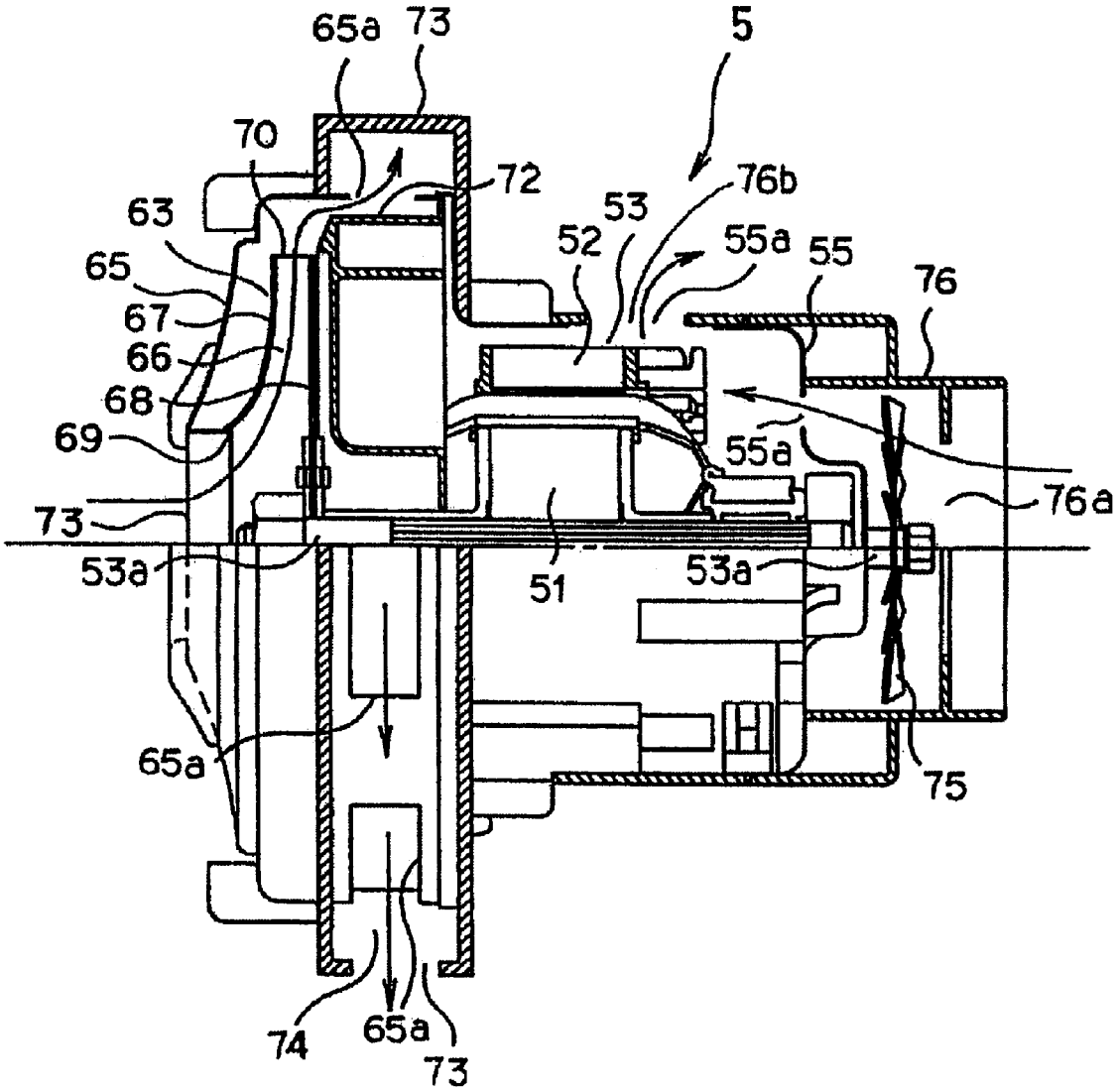
FIG. 10 is a partially cut-away cross-section drawing showing the structure of the electric blower according to the above embodiment.

Referring to FIG. 8 through FIG. 10, there is shown another embodiment of the present invention. Elements that are identical or similar to those from the embodiment described above will be assigned identical numerals and their descriptions will be omitted.

A cover body 76 covers the outer perimeter surface of the fan cover 65. A communicating opening 76*a* at the bottom of the cover body 76 provides communication between the cover body 76 and the exhaust flow path B. These elements form a bypass flow path 77 that circulates exhaust air from the electric blower 5 to the exhaust flow path B without going through the motor 5.

A cooling fan 78, attached toward the rear end of the rotation shaft 53*a* of the motor 53, is covered by a housing 79, which includes a suction opening 79*a* that faces the exhaust opening 11 of the main cleaning device unit 1. The bracket 55 of the motor 53 is formed with an air blower opening 55*a* that blows outside air brought in by the cooling fan 78 on the coils (heat-generating bodies) of the rotor 51 and the stator 52 that form the motor 53. After cooling the coils of the rotor 51 and the stator 52, the exhaust air is discharged from the bracket 55 and the discharge opening 79*b* formed on the housing 79 into the motor chamber 6. The exhaust air is then discharged outside the exhaust opening 11 of the main cleaning device unit 1 via the opening 6*a* formed at the bottom of the motor chamber 6.

An exhaust opening 80 is formed at the rear end of the exhaust flow path B formed toward the bottom of the main cleaning device unit 1. A portion of the exhaust air circulated from the bypass flow path 77 to the exhaust flow path B is discharged from the discharge opening 80 to the exhaust opening 11 of the main cleaning device unit 1. Thus, a portion of the exhaust air from the electric blower is discharged out from the exhaust opening 11 of the main cleaning device unit 1. An equivalent flow of air is sucked in from the outside into the floor suction tool 4. This improves the debris suction properties of the exhaust-circulating electric cleaning device. The proportion of exhaust air circulated to the exhaust flow path B to the floor suction tool 4 and the exhaust air discharged outside form the exhaust opening 11 of the main cleaning device 1 can be set to an optimum proportion by adjusting the area of the opening in the exhaust opening 80 or the like.

When using the electric cleaning device according to this embodiment, the exhaust air from the electric blower 5 is directly circulated from the fan cover 65 to the exhaust flow path B formed toward the bottom of the main cleaning device unit 1 via the bypass flow path 77. Thus, the air does not pass through the motor coils, which are heat-generating bodies, and can be circulated at a low temperature through the exhaust flow path B formed in the hose 2, the pipe 3, and the like. This allows the surface temperature of the hose 2 and the pipe 3 to be no more than about 45 deg C, thus preventing the user from feeling discomfort and preventing heat-resistance or lifespan problems in the resin parts such as the hose 2 and the pipe 3. Also, the motor 53 is cooled by a separate cooling fan 78. This prevents the motor 53 from overheating and malfunctioning.

As described above, the exhaust-circulating electric cleaning device according to this embodiment can prevent temperature increases in the circulating exhaust air. Also, the reduced temperature permits the hose 2, through which are formed the suction flow path A and the exhaust flow path B, to be made lighter and easier to assemble. Furthermore, the connecting pipe 3 can be made lighter and slimmer. Thus, the advantages provided by exhaust circulation can be implemented in a practical manner.

By circulating a portion of the exhaust air, the exhaust air blown outside is reduced and weakened. This efficiently restricts the blowing up of dust in the room during cleaning.

Also, the air speed of the exhaust air blown out from the exhaust opening 11 is reduced. This improves the effectiveness of the filtering performed by the exhaust filter 10 and allows the exhaust air to be cleaner. This is in line with the current trend toward increased concern for cleanliness.

Figures 11A, 11B, 11C, 11D, 11E, 11F:
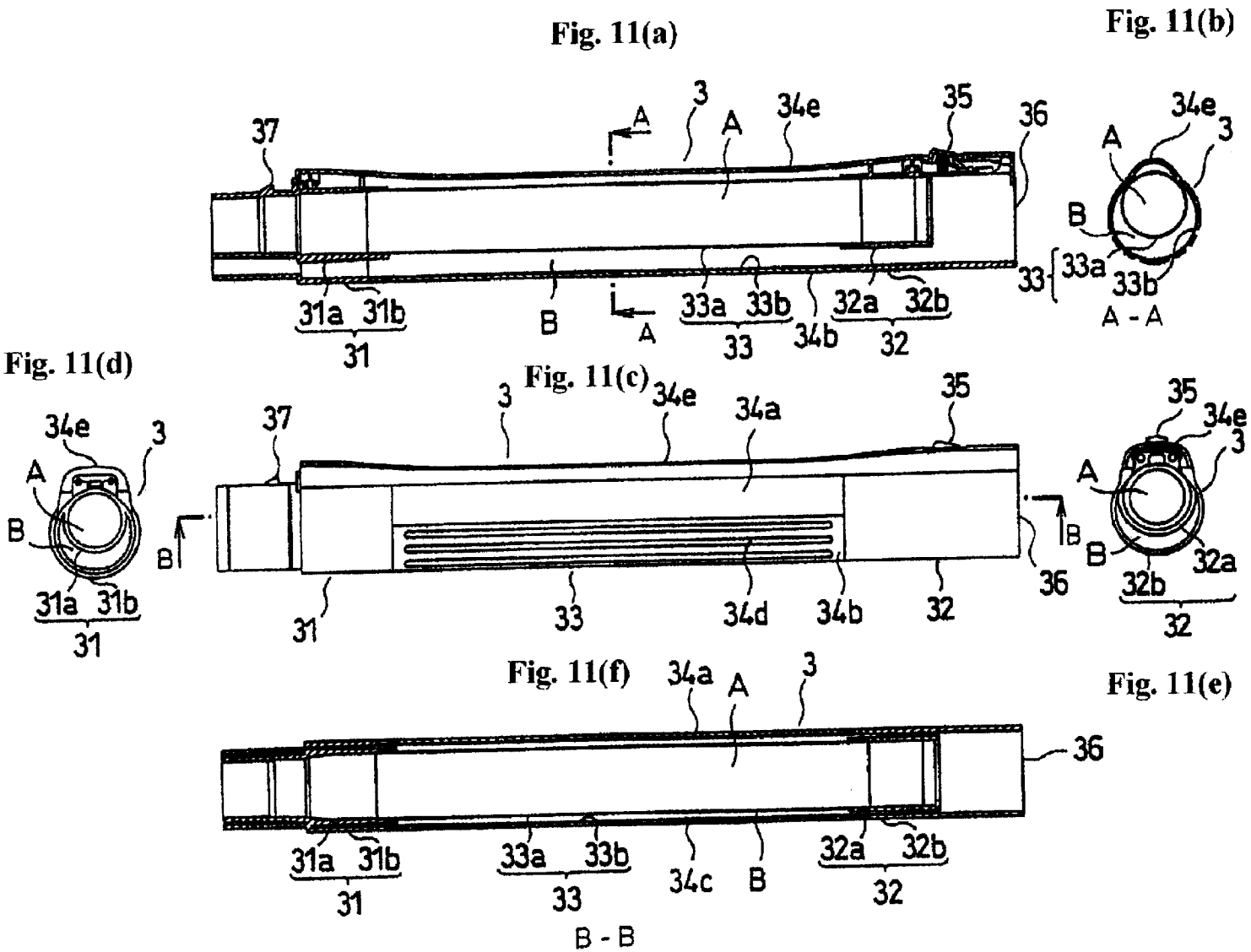
FIG. 11(*a*) shows a vertical cross-section drawing of a connecting pipe.
Figures 12A, 12B:
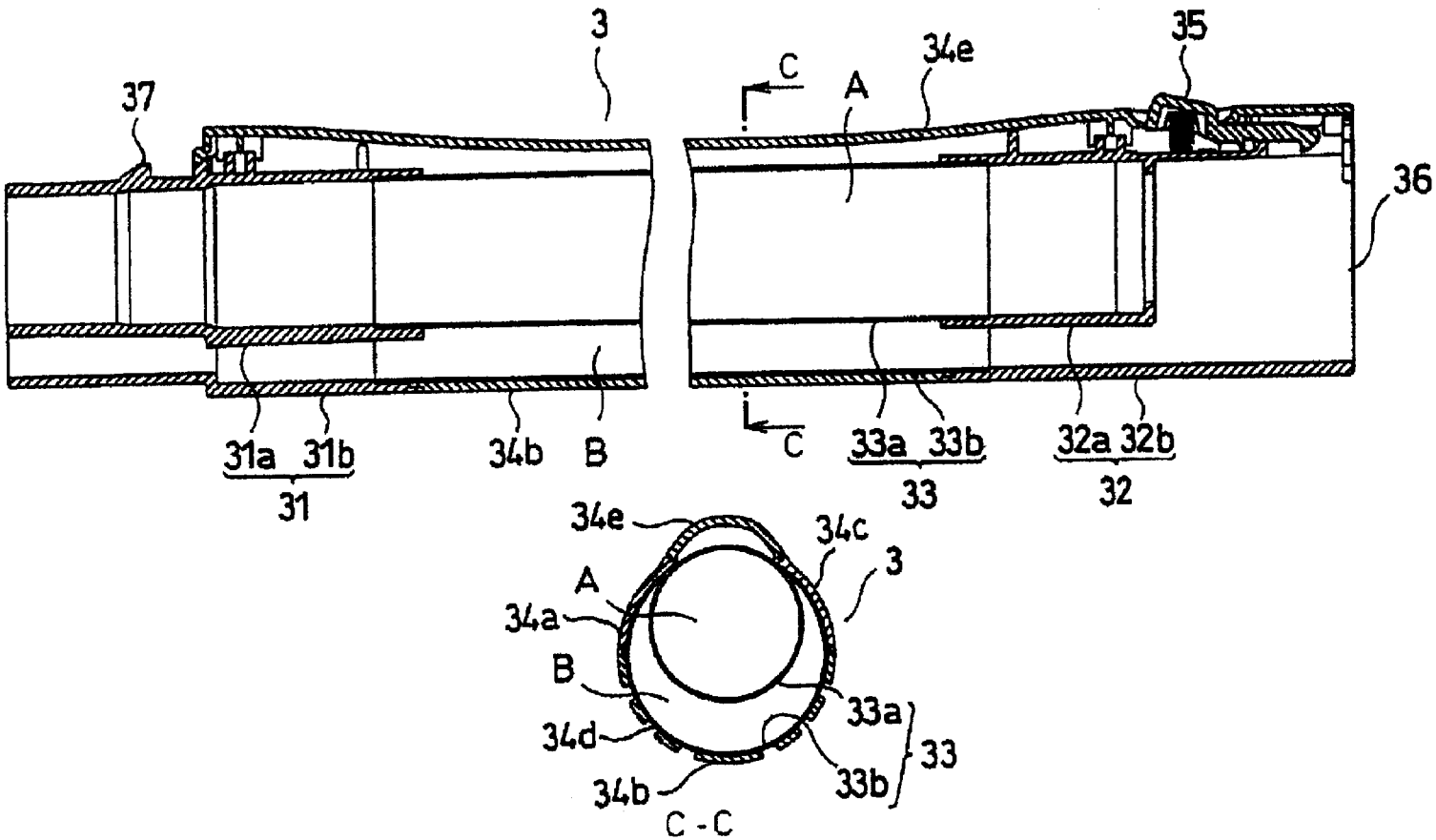
FIG. 12(*a*) is a cross- section detail drawing of a connecting pipe of FIG. 11(*a*) with one section omitted.
Figure 13A:
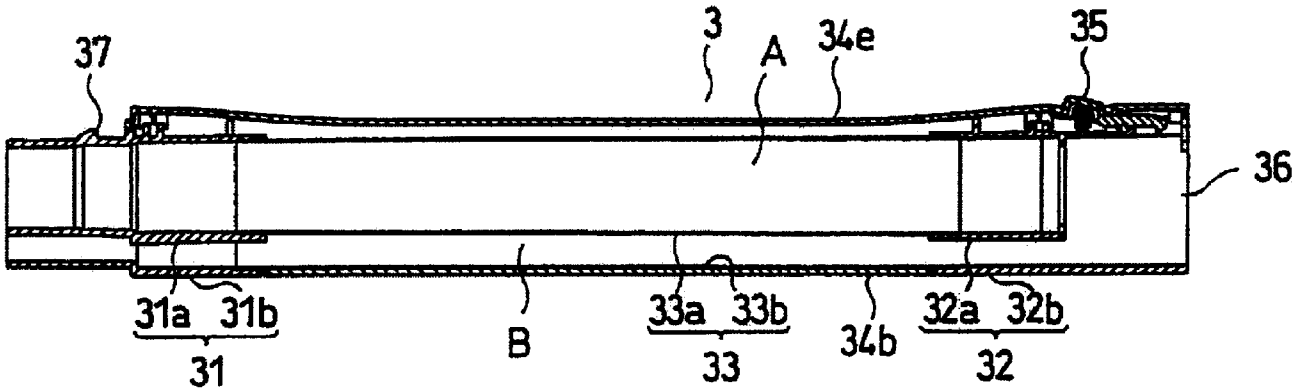
FIG. 13(*a*) is a vertical cross-section drawing showing the structure of the connecting pipe.
Figure 13B:
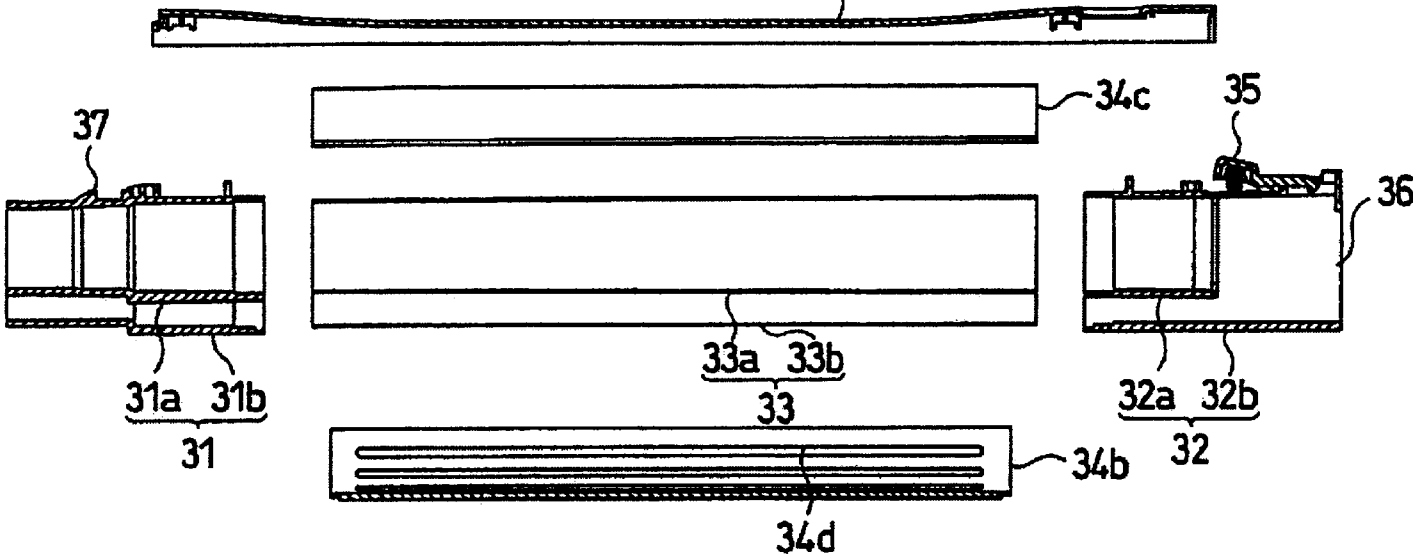

Referring to FIGS. 11(*a*) through FIG. 13(*b*), another embodiment of the connecting pipe 3 provides an improvement in the connecting pipe 3 to increase the heat dissipation effect and to prevent temperature increases in the circulated exhaust air.

Due to the necessities of the connecting structure, the ends of the connecting pipe 3 use two-layered pipes 31, 32 formed from resin as in the embodiments described above. However, a two-layered pipe 33 formed from aluminum having high heat dissipation properties is used between the ends 31–32.

In these two-layered pipes 31–33, inner cylindrical sections 31*a*–33*a* form suction flow paths A having roughly circular cross-sections. Outer cylindrical sections 31*b*–33*b* are formed integrally with the upper sections of the inner cylindrical sections 31*a*–33*a* and cover the inner cylindrical sections 31*a*–33*a*, forming exhaust flow paths B.

The exhaust air flowing through the exhaust flow paths B is clean air from which dust has been removed by the paper pack 7 and the fine dust filter 8 of the main cleaning device unit 1. Thus, there is no need to form the flow paths with a roughly circular cross-section to prevent clogging as with the inner cylindrical sections 31*a*–33*a*. Thus, in this embodiment the exhaust flow paths B is formed with a roughly crescent-shaped cross-section and the outer cylindrical sections 31*b*–33*b* are formed with roughly circular cross-sections.

The aluminum two-layered pipe 33 having the structure described above can be easily formed integrally using extrusion molding.

The outer surface of the aluminum outer cylindrical section 33*b* is covered by resin covers 34*a*–34*c* in order to prevent direct contact from hands of the user. The cover 34*b*, which covers the lower half having a large exhaust flow area, is formed with a plurality of slits 34*d* in order to dissipate heat outside.

As with the conventional technology, a cover 34*e* is mounted above the connecting pipes 3 to cover cables and the connecting clamp 35.

Connecting pipe 3 described above, can be two or more connecting pipe 3 connected end to end as is conventional.

On the side toward the suction opening 36 connecting to the floor suction tool 4, the partition wall (inner cylindrical section 32) separating the suction flow path A and the exhaust flow path B is offset toward the inside of the pipe by a predetermined distance.

At the other end of the connecting pipe 3, the outer cylindrical section 31*b* is formed with a slightly smaller diameter corresponding to the suction opening of the grip 24 and the suction opening 36 of the connecting pipe 3. This allows the outer cylindrical section 31*b* to be fitted into the inner perimeter of the suction opening side. A projection 37 is formed on the upper section of the outer cylindrical section 31*b* to engage a clamp on the suction opening side.

By using aluminum for the section of the connecting pipe 3 through which exhaust air passes, heat dissipation properties are improved and temperature increases in the circulating exhaust air are restricted.

Also, since the upper section of the connecting pipe 3 described above is formed integrally, the use of aluminum makes the structure lighter and more slim. Furthermore, since the inner and outer layers are both formed with roughly circular cross-sections, the structure is easy to use while still being strong. Thus, the connecting pipe 3 according to this embodiment is no less comfortable compared to the conventional structure for suction only, while roughly the same shape and ease of use is provided.

Figure 14A:
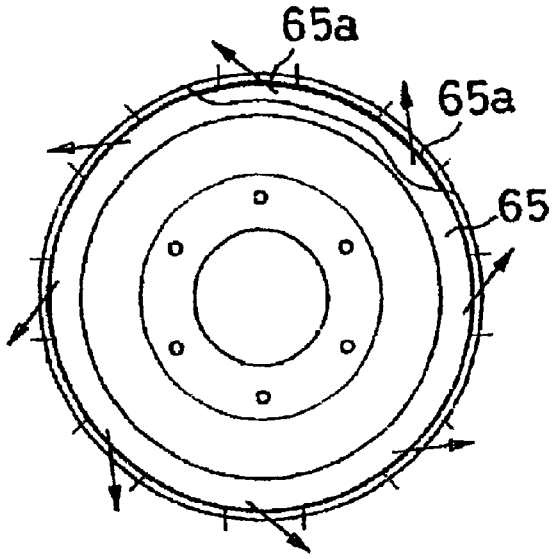
FIG. 14(*a*) shows formations of the exhaust openings in the outer perimeter section of the fan cover with roughly uniform intervals.
Figure 14B:
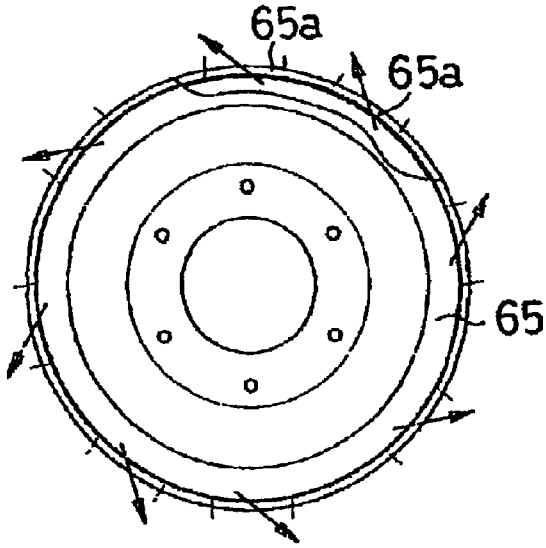
Figure 14C:
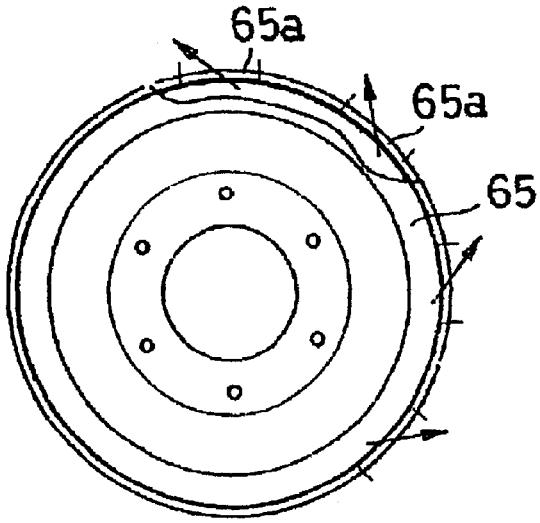

Referring to FIG. 14(*a*), in the embodiments described above the exhaust openings 65*a* are formed at roughly equal intervals on the outer perimeter section of the fan cover 65. Referring to FIG. 14(*b*), however, it would also be possible to form the exhaust openings 65*a* with non- uniform intervals. Referring to FIG. 14 (*c*), it would also be possible to form the exhaust openings 65*a* on only one side of the perimeter of the outer perimeter section of the fan cover 65.

Referring to FIG. 14(*b*), by forming the exhaust openings 65*a* at non-uniform intervals, the discharge openings 70 formed at equal intervals at the outer perimeter section of the centrifugal fan 63 are not simultaneously aligned with each of the exhaust openings 65*a* of the fan cover 65. Thus, the noise emitted from the fan cover exhaust openings 65*a* is dispersed without going completely out from the fan cover 65. This allows the noise to be reduced.

Referring to FIG. 14(*c*), by forming the exhaust openings 65*a* on one side of the perimeter of the outer perimeter section of the fan cover 65, the exhaust space of the outer perimeter section of the fan cover 65 can be concentrated at one section. The creation of a section that does not require exhaust space allows space to be conserved while the concentration of the exhaust openings 65*a* improves the exhaust efficiency. Also, by having the exhaust openings 65*a* disposed at positions away from the outer fringe of the electric cleaning device or the like, the emitted noise can be reduced.

Figure 15C:
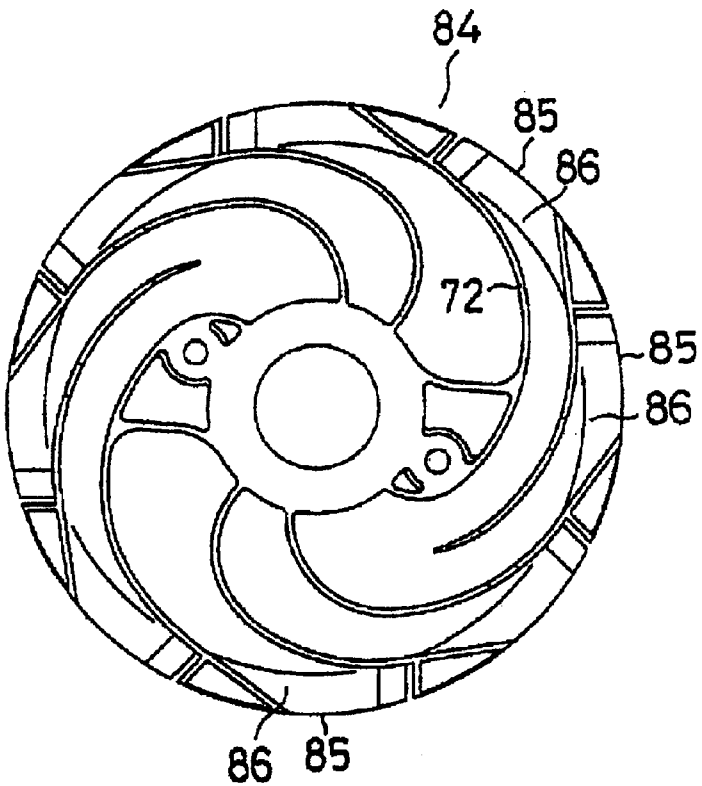
FIG. 15(*a*) is a front-view drawing of the centrifugal fan of a vane-less diffuser without volute ribs.
Figure 15B:
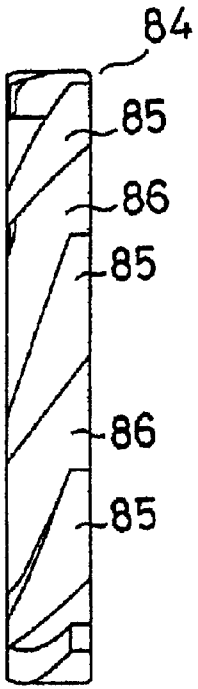
Figure 15A:
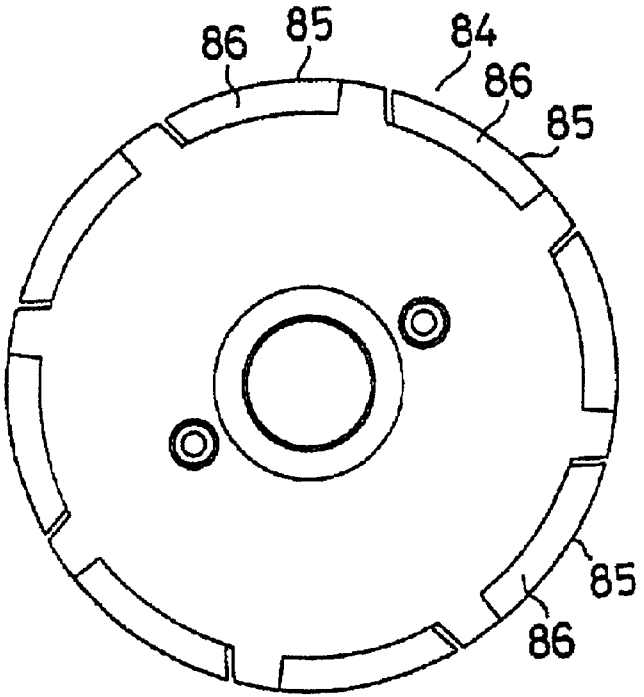

The embodiments described above use a vaned diffuser 64 having volute ribs 71 due to the ease of fixing and positioning the fan cover 65. Referring to FIGS. 15(*a*)–16, however, it is also possible to use a vane-less diffuser 84 that does not have volute ribs. The absence of volute ribs results in reduction of ventilation resistance, improved air flow, and reduced noise, thus making this structure useful for exhaust-circulating cleaning devices.

In place of volute ribs, this diffuser 84 is formed with a plurality of sloped ribs 85 disposed at the outer perimeter section of the diffuser 84. These sloped ribs 85 are sloped from the centrifugal fan 63 to the motor frame 54 along the direction of rotation of the centrifugal fan 63. Sloped paths 86 are formed between these sloped ribs 85.

Figure 17:
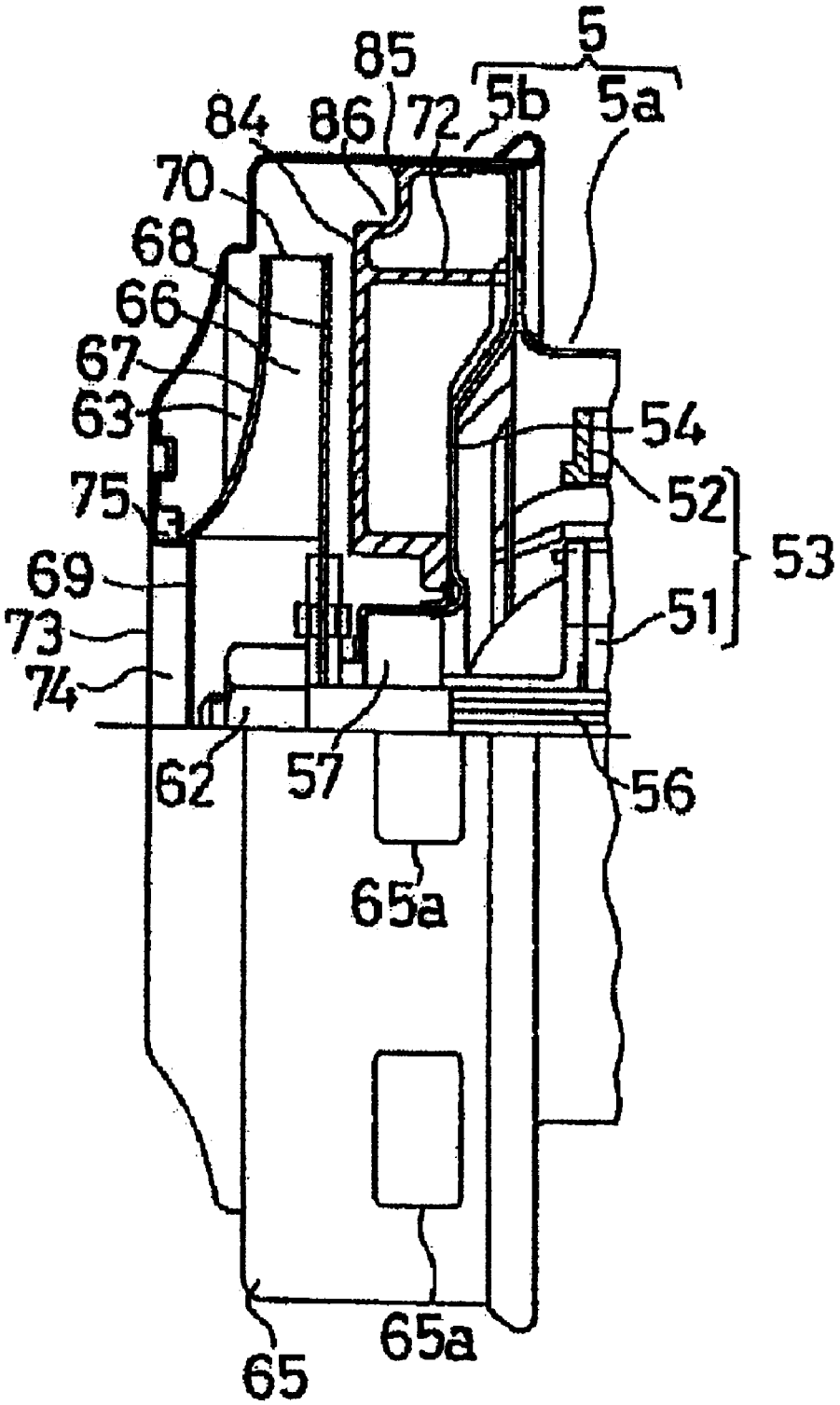
FIG. 17 is a half cross-section drawing showing the main elements of the electric blower that uses the vane-less diffuser described above.
Figure 18A:
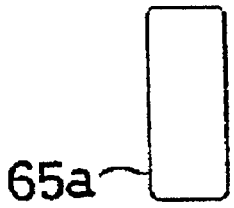
FIG. 18(*a*) shows rectangular exhaust openings on the outer perimeter of the fan cover.
Figure 18B:
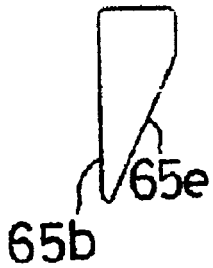
Figure 18C:
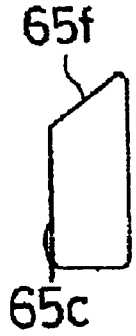
Figure 18D:
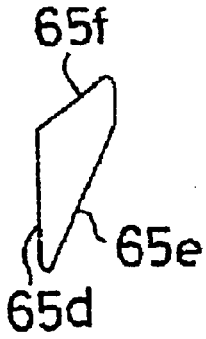

Referring to FIG. 17 and FIG. 18(*a*), the exhaust openings 65*a* at the outer perimeter section of the fan cover 65 can be formed with rectangular shapes as in the embodiments described above. Referring to FIG. 18(*b*)–18(*d*), however, it would also be possible to use alternative shapes for the exhaust openings 65*b*–65*d* to provide the advantages described below.

Referring to FIG. 18(*b*), an exhaust opening edge 65*e* opposite from the rotation direction of the centrifugal fan is formed so that it is aligned with the sloped rib shape 85*e* (see FIG. 16) in the rotation direction of the centrifugal fan 63. Thus, as the exhaust air is discharged outside from the fan cover exhaust openings 65*b* via the diffuser sloped paths 86, the dynamic pressure is converted to static pressure, thus providing similar advantages as those of the embodiments described above. Also, since exhaust openings 65*b* are formed at areas that are not covered up by the sloped ribs 85 of the diffuser 84, the reduction in strength of the fan cover 65 resulting from the formation of the exhaust openings 65*b* can be kept to a minimum.

Referring to FIG. 18(*c*), an exhaust opening edge 65*f* toward the rotation direction of the centrifugal fan 63 is sloped relative to the motor axis direction. Thus, when the exhaust air is discharged, it is not separated into portions inside and outside the fan cover 65 at once at the opening edge 65*f* toward the centrifugal fan rotation direction, which is where the most noise is generated. Instead, the incline provides an offset so that noise can be reduced.

Figure 19:
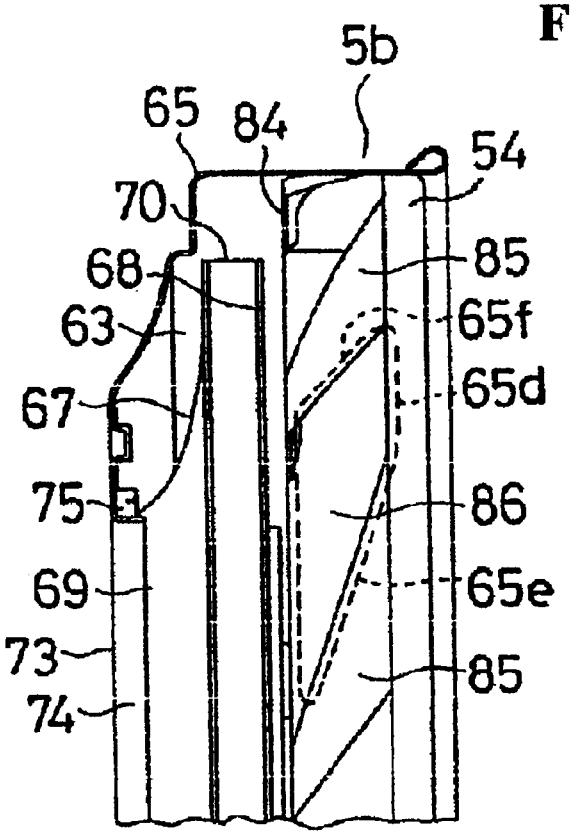
FIG. 19 is a drawing showing the positioning of the outer perimeter surface of the diffuser and the exhaust openings when the exhaust opening shape shown in FIG. 18(*d*) is used.

Referring to FIG. 18(*d*), in which the above shapes are combined, the exhaust opening 65*d* can be positioned relative to the outer perimeter surface of the diffuser 84 as indicated by the dotted lines in FIG. 19. Thus, reductions in the strength of the fan cover 65 can be avoided while noise is reduced.

As described above, the electric motor 5 used in electric cleaning devices and the like can be formed with vaned diffusers 64 having volute ribs 71 or vane-less diffusers 84. Referring to FIG. 3, if the vaned diffuser 64 is used, the volute ribs 71 abut the ceiling of the fan cover 65 thus allowing the fan cover 65 to be accurately positioned and fixed in the axial direction.

With the vane-less diffuser 84, however, the absence of volute ribs prevents accurate positioning of the fan cover 65 in the axial direction. Thus, to allow accurate positioning, a skirt-shaped shelf needs to be formed at the outer perimeter edge of the motor frame 54 to allow fixing. Alternatively, an offset can be formed at the outer perimeter section of the fan cover 65 to abut the outer perimeter edge of the motor frame 54 to allow fixing.

With the former method, however, providing an adequate shelf for the fixing of the motor frame 54 and the fan cover 65 results in a larger motor frame 54, leading to increased weight and costs. Also, the shelf of the motor frame 54 determines the maximum outer diameter, and the ends have to be processed in order to protect lead wires. This reduces ease of production and increases costs.

With the latter method, the maximum outer diameter of the electric blower 5 does not change but the offset reduces the air flow area within the fan cover 65, thus decreasing performance.

With either method, modifying dies from their current shapes requires major changes. This creates problems such as die modification costs and inability to reuse dies since there is no compatibility with current products. More specifically, two dies would be necessary.

As described above, in electric blowers that seek to provide high performance, a ring-shaped sealing member 75 formed from PTFE or the like is disposed between the suction opening 69 of the centrifugal fan 63 and the suction opening 73 of the fan cover 65, thus allowing the rim of the suction opening 69 of the centrifugal fan 63 to slide against the ring-shaped sealing member 75. However, variations and deformations in the various parts can change the position of the centrifugal fan, resulting in too much or not enough contact with the ring-shaped sealing member 75. Each time this happens, the die must be modified to adjust the axial height of the suction opening 73 of the fan cover 65. This requires die modification costs and reduces the lifespan of a die, while also preventing the use of the die during modification.

Figure 16:
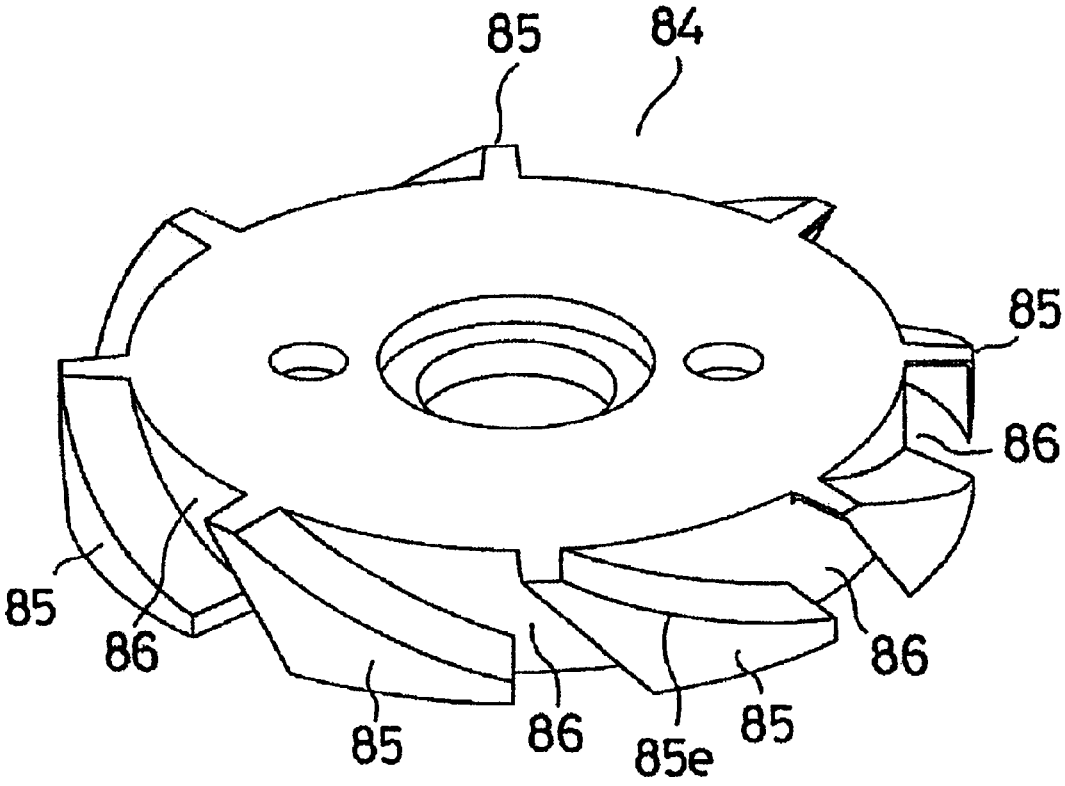
FIG. 16 is a perspective drawing of the vane-less diffuser without volute ribs.
Figure 20:
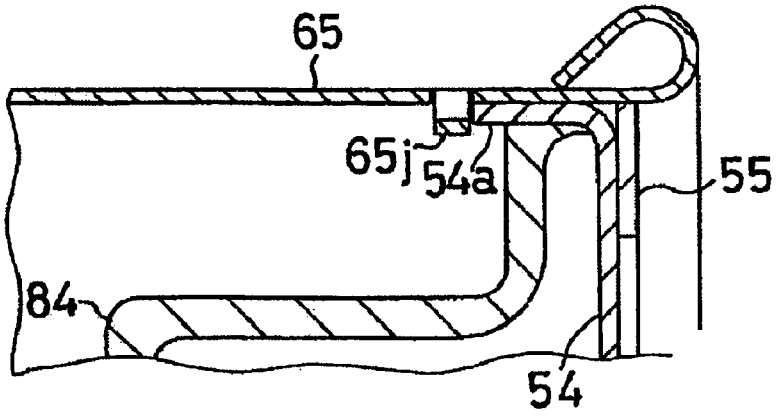
FIG. 20 is a schematic cross-section drawing showing the position of a fan cover positioning/fixing section formed projecting inward on the outer perimeter section of the fan cover and the positioning/fixing state according to one embodiment.
Figure 21:
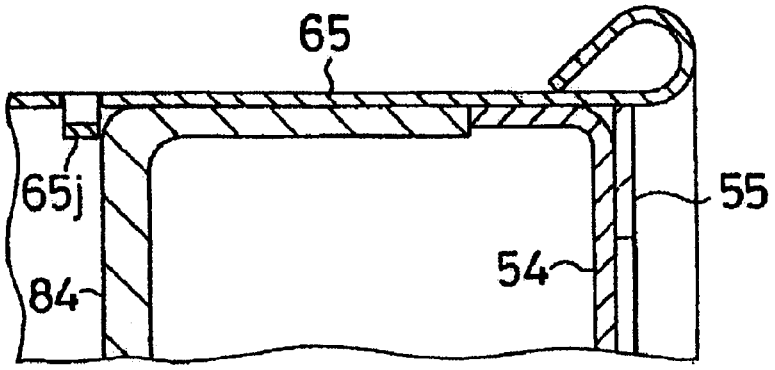
FIG. 21 is a schematic cross-section drawing showing the position of a fan cover positioning/fixing section and the positioning/fixing state according to another embodiment.
Figure 22:
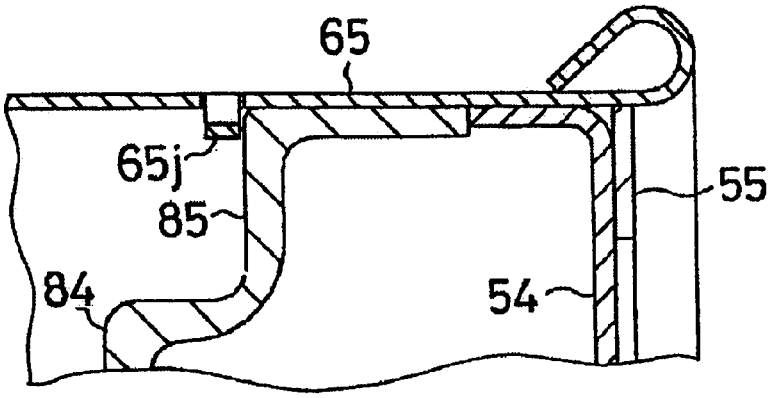
FIG. 22 is a schematic cross-section drawing showing the position of a fan cover positioning/fixing section and the positioning/fixing state according to another embodiment.

Referring to FIG. 20 through FIG. 22, there is shown a schematic cross-section drawing of a structure that eliminates the problems described above. The figures show the positioning and the fixing effect provided by an inwardly projecting fan cover positioning/fixing section (here, a roughly V-shaped piece 65*j* formed by cutting and bending and shown in FIGS. 24(*a*)–(*c*) described later) formed at the outer perimeter section of the fan cover 65. The reason the shape of the diffuser 84 appears different is that the cross-section position of the vane-less diffuser 86 shown in FIG. 15 and FIG. 16 is different.

Referring to FIG. 20, the positioning/fixing section (the roughly V-shaped piece 65*j*) is formed at the outer perimeter section projecting inward and abutting the fan cover mounting edge 54*a* of the motor frame 54 in order to fix the fan cover mounting position at a predetermined position. With this structure, the fan cover can be fixed along the direction of the axis of the fan cover 65 for the vane-less diffuser 84 not having volute ribs without changing the outer dimensions of the electric blower 5 at all. Also, this structure can be formed at the same time that the exhaust openings 65*a*65*d* are formed on the fan cover 65, thus allowing the number of steps required to be minimized.

Referring to FIG. 21, the positioning/fixing section (the roughly V-shaped piece 65*j*) for fixing the fan cover mounting position at a predetermined position is formed at the outer perimeter section of the fan cover 65 projecting inward and abuts the outer perimeter edge of the diffuser 84 toward the centrifugal fan. In addition to the advantages described above, this structure holds the outer perimeter edge of the diffuser 84 to reliably fix the diffuser 84, thus vibrating contact with the motor frame 54 and the fan cover 65 can be prevented and vibration and noise from the electric blower 5 can be reduced.

In FIG. 21, the piece 65*j* abuts the outer perimeter edge of the diffuser 84 toward the centrifugal fan.

Referring to FIG. 22, it would also be possible to have the piece 65*j* abut an intermediate position of the sloped rib 85 at the outer perimeter edge of the diffuser 84.

Figure 23A:
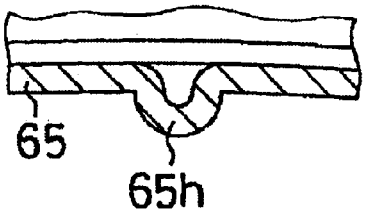
FIG. 23(*a*) is a schematic cross-section drawing of fan cover positioning/fixing sections as seen from the front of the fan cover.
Figure 23B:
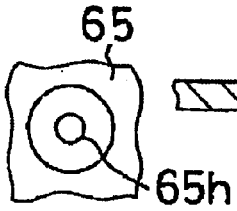
Figure 23C:
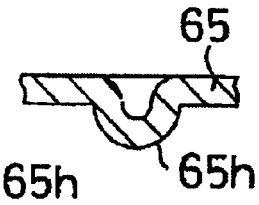
Figure 27A:
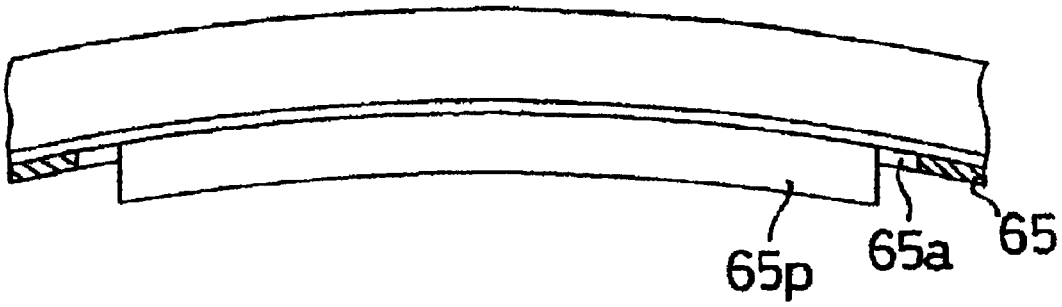
FIG. 27(*a*) is a schematic cross-section drawing of another embodiment of a fan cover positioning/fixing section as seen from the front of the fan cover.
Figure 27B:
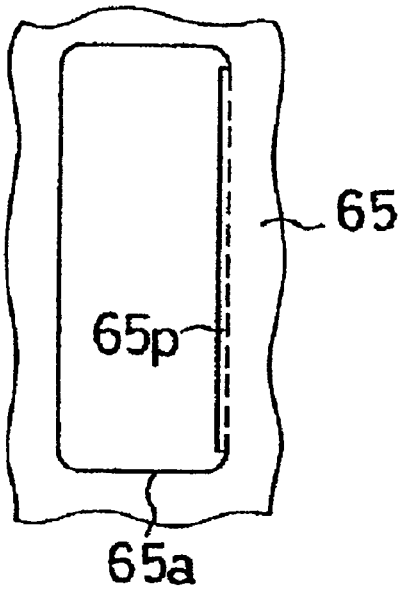
Figure 27C:
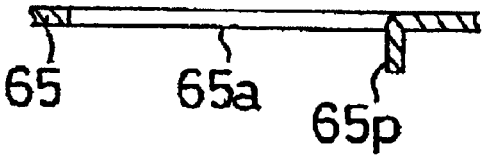

Referring to FIG. 23(*a*) through FIG. 27(*c*), there are shown various examples of structures for the fan cover positioning/fixing section described above. In each figure, (*a*) is a schematic cross- section drawing as seen from the front of the fan cover 65, (*b*) is a schematic plan drawing, and (*c*) is a schematic cross-section drawing as seen from the side.

Referring to FIGS. 23(*a*)–(*c*), the positioning/fixing section shown is the most simple. An inwardly projecting projection 65*h* is formed using a punch or the like. This requires only slight modification to the fan cover 65 and can be performed through post-processing or the like. Since the projection 65*h* can be formed through post-processing, the same dies used in the conventional technology can be used. Also, the position of the projection 65*h* can be easily modified by adjusting automated devices. Thus it is possible to easily adjust the sliding contact between the edge of the suction opening 69 of the centrifugal fan 63 and the ring-shaped sealing member 75 made from PTFE or the like and attached to the edge of the suction opening 73 of the fan cover 65. As a result, if variations or deformations in parts cause the fan position to change, leading to too much or not enough contact with the ring-shaped sealing member 75, adjustments can be made immediately.

Figure 24A:
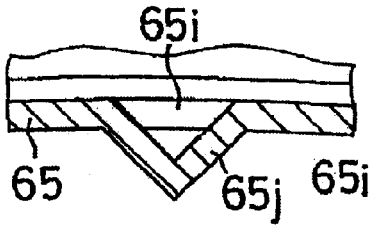
FIG. 24(*a*) is a schematic cross-section drawing of another embodiment of a fan cover positioning/fixing section as seen from the front of the fan cover.
Figure 24B:
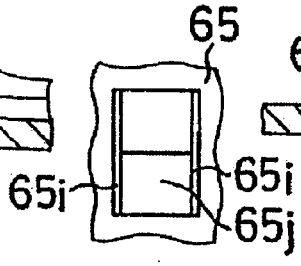
Figure 24C:
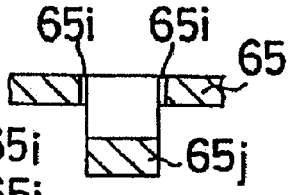

Referring to FIGS. 24(*a*)–(*c*), grooves 65*i*, 65*i* are formed parallel to the perimeter of the outer perimeter section of the fan cover 65. The roughly V-shaped piece 65*j* is projected inward (same as in FIG. 20 through FIG. 22 described above). In addition to the advantages described above, in this structure the abutment of the V-shaped piece 65*j* occurs over a uniform line, thus preventing variations in the fixing position of the fan cover 65 that occur with the projection 65*h* described above due to the depth of the projection and the manner of abutment.

Figure 28A:
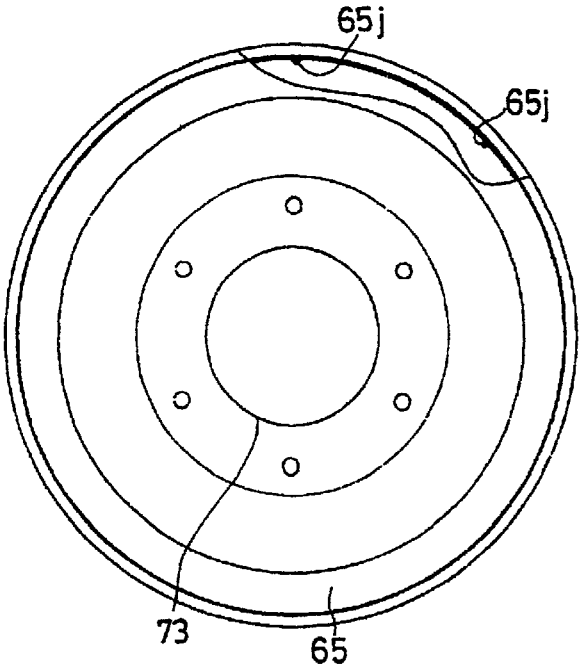
FIG. 28(*a*) is a front-view drawing of a fan cover on which a roughly V-shaped piece is bent up as a positioning/fixing section.
Figure 28B:
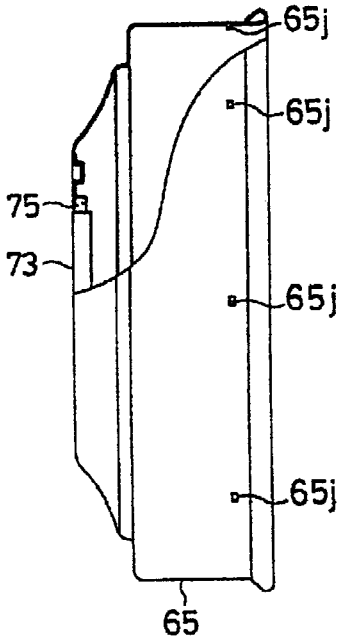

Referring to FIGS. 28(*a*)–(*b*), there is shown an example of the fan cover 65 formed with a plurality of the roughly V-shaped piece 65*j* spaced about its perimeter.

Figure 29B:
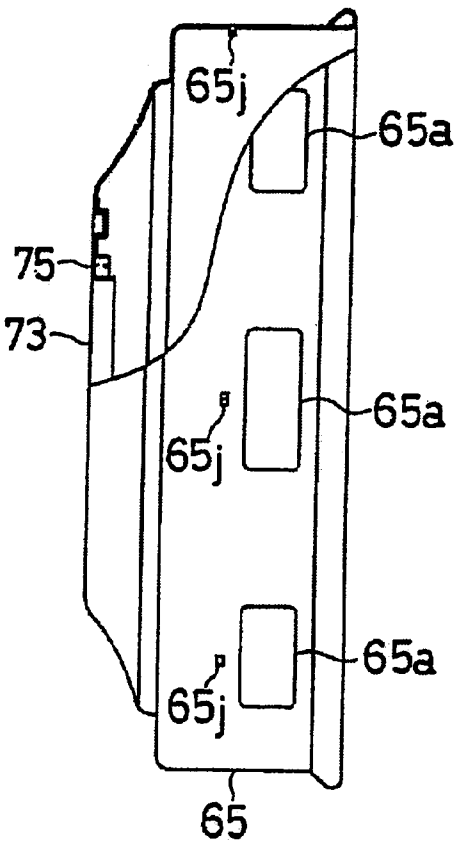
FIG. 29(*a*) is a front-view drawing of a fan cover on which a roughly V-shaped piece is bent up and combined with an exhaust opening.
Figure 29A:
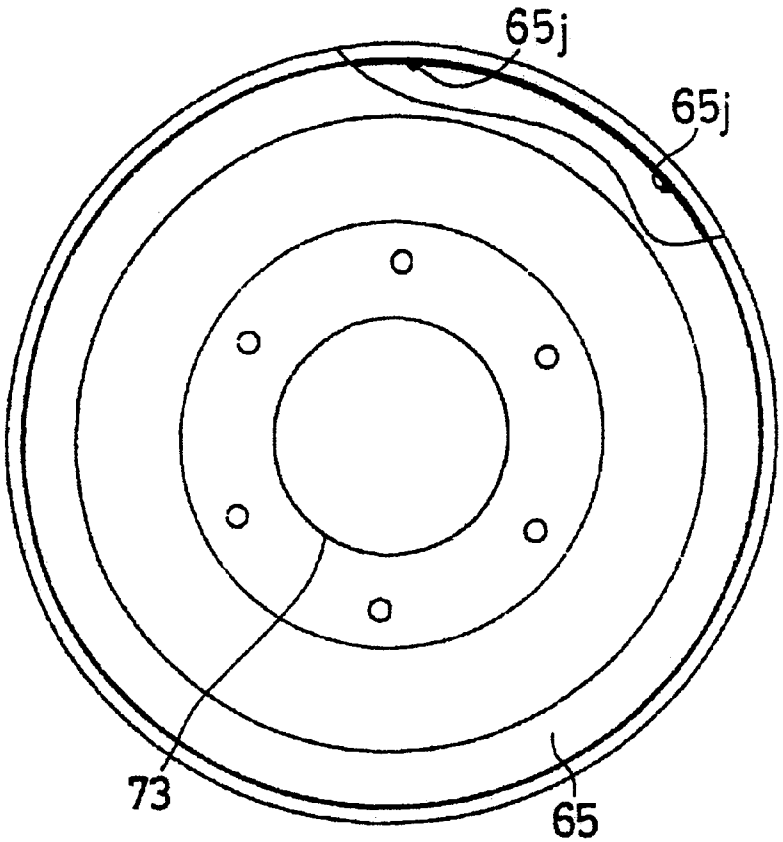

Referring to FIGS. 29(*a*)–(*b*), there is shown an example where a structure is formed in combination with the exhaust openings 65*a*. In this example the presence of the exhaust openings 65*a* allows the pieces 65*j* to be somewhat larger without affecting performance or noise.

Figure 25A:
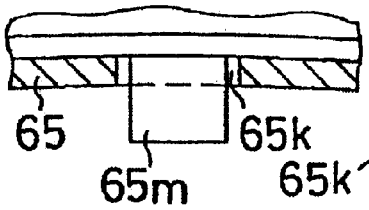
FIG. 25(*a*) is a schematic cross-section drawing of another embodiment of a fan cover positioning/fixing section as seen from the front of the fan cover.
Figure 25B:
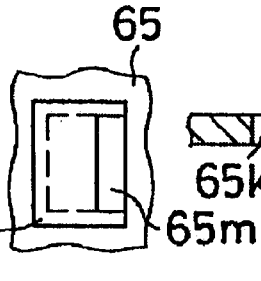
Figure 25C:
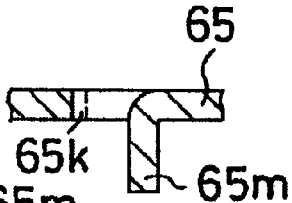

Referring to FIGS. 25(*a*)–(*c*), roughly U-shaped indentations 65*k* are formed along the direction of the motor shaft at the outer perimeter section of the fan cover 65. Pieces 65*m* are bent roughly perpendicularly inward. In addition to the advantages described above, this structure provides a uniform surface abutment at the pieces 65*m*, thus allowing the fan cover 65 to be reliably fixed.

Figure 26A:
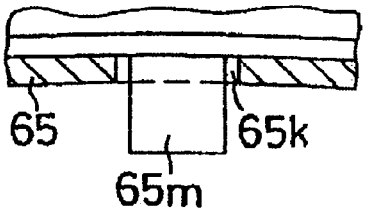
FIG. 26(*a*) is a schematic cross-section drawing of another embodiment of a fan cover positioning/fixing section as seen from the front of the fan cover.
Figure 26B:
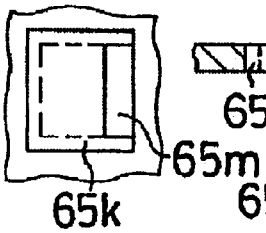
Figure 26C:
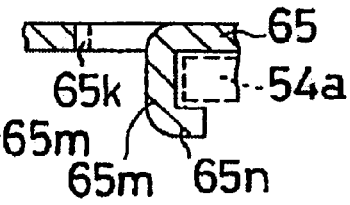

Referring to FIGS. 26(*a*)–(*c*), ends 65*n* of the pieces 65*m* are bent roughly perpendicular toward the motor frame 54 based on the thickness of the fan cover mounting edge 54*a* of the motor frame 54. As a result, the fan cover 65 is fixed so that the fan cover mounting end 54*a* of the motor frame 54 is sandwiched in from both sides, thus allowing, the fan cover 65 to be reliably fixed.

Referring to FIGS. 27(*a*)–(*b*), pieces 65*p* are formed by bending inward the edge extending along the perimeter of the exhaust opening 65*a*, at the outer perimeter section of the fan cover 65, at roughly a right angle. This structure can be formed by simply leaving behind a section of the material that is cut away to open the exhaust opening 65*a* and bending it. This reduces the modifications required for the die and minimizes cost increases. Also, the fan cover 65 is reinforced and the structure also substitutes for the processing of the edge.

Figure 30:
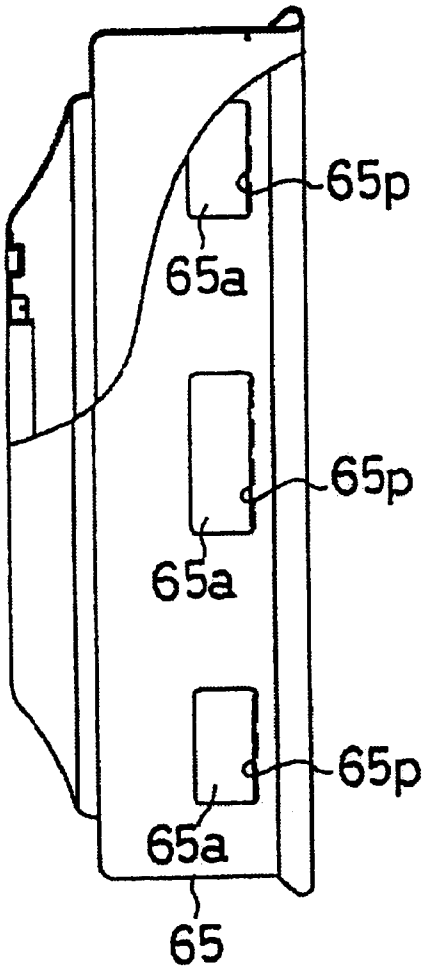
FIG. 30(*a*) is a front- view drawing of a fan cover on which an exhaust opening is formed integrally with a piece that is bent up to form a positioning/fixing piece.
Figure 30:
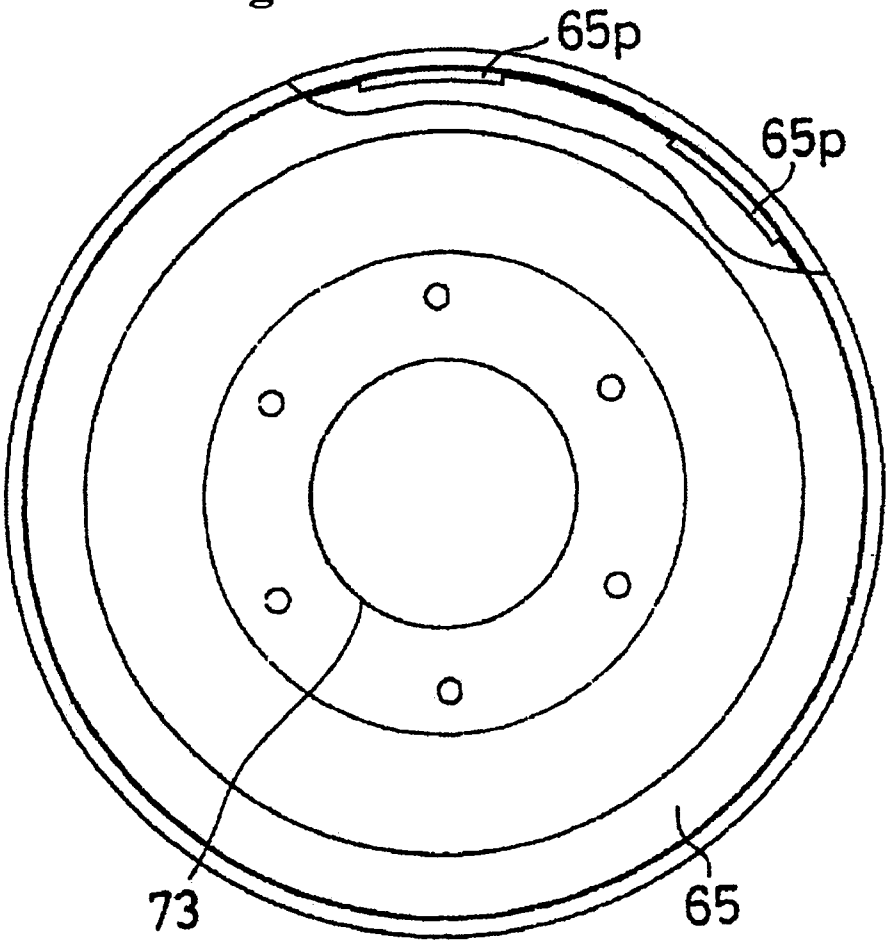

Referring to FIG. 30, there is shown an example of the fan cover 65 where the exhaust opening 65*a* and the positioning/fixing piece 65*p* are formed integrally.

In the description of the above embodiments, the fixing/positioning section is formed on the fan cover 65 where the vane-less diffuser 84 with no volute ribs is used. Referring to FIG. 5, the positioning/fixing sections can also be formed with the vaned diffuser 64 having the volute ribs 71. If for some reason the volute ribs 71 are deformed or destroyed, the positioning/fixing section will serve as a stopper to prevent the fan cover 65 from moving along the axial direction, where it would come into contact with the centrifugal fan 63 and be damaged.

In the embodiments described above, the exhaust openings 65*a* are formed at the outer perimeter section of the fan cover 65. However, it would also be possible to form the exhaust openings 65*a* at other positions such as at the front of the fan cover 65 or at the rear of the fan cover 65. When an electric blower in which the exhaust openings 65*a* are formed at the outer perimeter section of the fan cover 65 is mounted on the main cleaning device unit, an exhaust flow path must be formed at the outer perimeter section of the fan cover 65 and the radial dimension of the main cleaning device unit 1 must be increased. However, with these structures the exhaust flow path is formed at the front or the rear of the fan cover 65 so that there is no need to increase the radial dimension of the main cleaning device unit 1. This allows the main cleaning device unit 1 to be made more compact.

Also, in the embodiments described above the exhaust opening 11 is formed on the main cleaning device unit 1. However, it would also be possible to form the exhaust opening at the exhaust flow path B. For example, an air permeable material can be used to form the outer hose 2*b* and this permeable section of the outer hose 2*b* can serve as the exhaust opening.

The invention described above provides an electric blower in which the exhaust air discharged radially from the centrifugal fan is redirected toward the motor drive section by the diffuser and the fan cover. The air passes through the ventilation opening of the motor frame and through the bracket to cool the motor drive section. Exhaust openings are formed at a section of the fan cover and a portion of the exhaust air from the centrifugal fan is discharged from the exhaust openings of the fan cover. This reduces the overall ventilation resistance and increases the suction volume, thus improving the performance of the electric blower.

Also, by forming the exhaust openings at the outer perimeter section of the fan cover, the amount of ventilation resistance can be reduced and the suction volume can be increased, thus improving the performance of the electric blower.

Also, by having a cooling fan disposed to cool the motor drive section, problems such as malfunction of the motor due to overheating are eliminated and the temperature of the circulating exhaust air is prevented from increasing. Thus, discomfort to the user if the hose or the pipe is touched is prevented.

Also, the electric blower described above can be used in exhaust-circulating cleaning devices, where an exhaust path for circulating exhaust air from the electric blower is formed along with a suction path in the hose, pipe, and the suction tool connected to the main cleaning device unit. The exhaust air from the exhaust opening at the outer perimeter section of the fan cover is circulated in the exhaust flow path. This prevents the temperature of the circulating exhaust air from increasing and prevents soiling due to carbon particles while providing a compact, low-cost structure without the use of a "wet and dry" motor. Thus, the implementation of the exhaust-circulating cleaning device is made easier.

When the electric blower described above is used in exhaust-circulating cleaning devices, where an exhaust path for circulating exhaust air from the electric blower is formed along with a suction path in the hose, pipe, and the suction tool connected to the main cleaning device unit, the exhaust air from the exhaust openings of the fan cover can be circulated through the exhaust flow path while a portion of the exhaust air circulating in the exhaust flow path is discharged outside through an exhaust hole. This prevents the temperature of the circulating exhaust air from increasing while avoiding problems such as malfunctions of the motor due to overheating. As a result, problems such as user discomfort due to touching the hose or pipe as well as limited heat resistance and lifespan of resin elements such as the hose and the pipe can be avoided. Thus, the implementation of the exhaust-circulating cleaning device is made easier.

Furthermore, exhaust openings can be formed on the main cleaning device unit to discharge air used for cooling the motor to the outside. This prevents the temperature in the main cleaning device unit and eliminates the need for heat resistance in the elements used in the main cleaning device unit.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electric blower comprising:

a centrifugal fan;

a motor frame;

a diffuser interposed between said centrifugal fan and said motor frame;

a bracket;

a motor drive section mounted in said bracket;

said bracket being disposed downstream from said motor frame;

a fan cover covering said centrifugal fan and said diffuser;

said diffuser and said fan cover redirecting exhaust air discharged radially from said centrifugal fan to said motor drive section;

a ventilation opening in said motor frame;

said ventilation opening permitting exhaust air passing from said ventilation opening through said bracket to cool said motor drive section;

an exhaust opening in said fan cover; and a portion of exhaust air discharged from said centrifugal fan is discharged from said exhaust opening.

2. An electric blower as described in claim 1 wherein said exhaust opening is located at an outer perimeter section of said fan cover.

3. An electric blower as described in claim 1 further comprising a cooling fan disposed to cool said motor drive section.

4. An electric cleaning device comprising:

a main cleaning device unit:

a centrifugal fan in said main cleaning device unit;

a motor frame in said main cleaning device unit;

a diffuser interposed between said centrifugal fan and said motor frame;

a bracket;

a motor drive section mounted in said bracket;

said bracket being disposed downstream from said motor frame;

a fan cover covering said centrifugal fan and said diffuser;

said diffuser and said fan cover redirecting exhaust air discharged radially from said centrifugal fan to said motor drive section;

a ventilation opening in said motor frame;

said ventilation opening permitting exhaust air passing from said ventilation opening through said bracket to cool said motor drive section;

an exhaust opening in said fan cover; and a portion of exhaust air discharged from said centrifugal fan is discharged from said exhaust opening;

a conduit in at least one of a hose, a pipe and a suction tool connected to said main cleaning device unit;

said conduit including an exhaust flow path and a suction flow path;

said conduit conducting exhaust air discharged from said exhaust opening of said fan cover to said exhaust flow path.

5. An electric cleaning device according to claim 4, further including an exhaust hole for discharging to the outside a portion of said exhaust air circulating in said exhaust flow path.

6. An electric cleaning device according to claim 5, further including an exhaust opening formed on said main cleaning device unit to discharge to the outside air used by said cooling fan to cool said motor.

7. An electric cleaning device comprising:

a centrifugal blower;

a first conduit for conducting air through a wand toward said centrifugal blower;

a second conduit, parallel to said first conduit for conducting air from said centrifugal blower to a distal end of said wand for improving dirt removal, and for reducing a temperature of said wand;

said first conduit providing cooling air to a motor; and said second conduit receiving air which had not been passed over said motor, whereby air in said second conduit is cleaner and cooler than air which has passed over said motor.

8. An electric cleaning unit according to claim 7, wherein:

said centrifugal blower includes a fan cover;

said fan cover including at least one opening therein for bleeding off no more than a first portion of air from said centrifugal blower;

said at least one opening feeding air to said second conduit; and a second portion of said air being passed through a filter, and over said motor for cooling thereof.

9. An electric cleaning unit according to claim 8, further comprising an exhaust opening connected to said second conduit for discharging to the outside a portion of air passing therein without said portion passing through said second conduit.

* * * * *